US007946694B2

(12) United States Patent
Hagiwara et al.

(10) Patent No.: US 7,946,694 B2
(45) Date of Patent: May 24, 2011

(54) LIQUID EJECTING APPARATUS

(75) Inventors: Hiroyuki Hagiwara, Suwa (JP); Akihiko Maruyama, Matumoto (JP)

(73) Assignee: Seiko Epson Corporation, Tokyo (JP)

( * ) Notice: Subject to any disclaimer, the term of this patent is extended or adjusted under 35 U.S.C. 154(b) by 916 days.

(21) Appl. No.: 11/893,531

(22) Filed: Aug. 16, 2007

(65) Prior Publication Data

US 2008/0043074 A1 Feb. 21, 2008

(30) Foreign Application Priority Data

Aug. 17, 2006 (JP) ..... 2006-222805
Aug. 17, 2006 (JP) ..... 2006-222806

(51) Int. Cl.
*B41J 2/175* (2006.01)

(52) U.S. Cl. ..... 347/85; 347/86

(58) Field of Classification Search ..... 347/85–86
See application file for complete search history.

(56) References Cited

U.S. PATENT DOCUMENTS

| | | | | |
|---|---|---|---|---|
| 5,359,357 | A * | 10/1994 | Takagi et al. | 347/49 |
| 5,777,646 | A * | 7/1998 | Barinaga et al. | 347/86 |
| 6,796,635 | B2 | 9/2004 | Shinada | |
| 6,979,079 | B2 | 12/2005 | Hashii et al. | |
| 7,008,053 | B2 | 3/2006 | Hashii et al. | |
| 7,040,744 | B2 | 5/2006 | Shinada | |
| 2002/0089576 | A1 * | 7/2002 | Ishizawa et al. | 347/86 |
| 2002/0109760 | A1 * | 8/2002 | Miyazawa et al. | 347/86 |
| 2005/0200670 | A1 | 9/2005 | Hashii et al. | |
| 2006/0001707 | A1 * | 1/2006 | Ito et al. | 347/85 |
| 2006/0152564 | A1 | 7/2006 | Hashii et al. | |
| 2007/0103515 | A1 | 5/2007 | Hashi et al. | |
| 2007/0103522 | A1 | 5/2007 | Hashii et al. | |

FOREIGN PATENT DOCUMENTS

| | | |
|---|---|---|
| JP | 07-304184 | 11/1995 |
| JP | 2003-341087 | 3/2003 |
| JP | 2003-182099 | 7/2003 |
| JP | 2004-122704 | 4/2004 |
| JP | 2004-351936 | 12/2004 |
| JP | 2005-22345 | 1/2005 |
| JP | 2006-116793 | 5/2006 |

* cited by examiner

*Primary Examiner* — Ellen Kim
(74) *Attorney, Agent, or Firm* — Nutter McClennen & Fish LLP; John J. Penny, Jr.; Michael P. Visconti, III

(57) ABSTRACT

A liquid ejecting apparatus includes: a flow channel unit, having a liquid flow channel for supplying a liquid stored in a liquid cartridge; and a plurality of cartridge holders, including a first cartridge holder and a second cartridge holder adjacent to each other, and attached to the flow channel unit while the cartridge holders are arranged in a first direction, each of the cartridge holders adapted to hold the liquid cartridge and having a first engaging portion and a second engaging portion. The first engaging portion of the first cartridge holder and the second engaging portion of the second cartridge holder are engageable with each other to lock the first and second cartridge holders, and the first engaging portion of the first cartridge holder and the second engaging portion of the second cartridge holder are disengageable from each other to unlock the first and second cartridge holders when one of the first and second cartridge holders is moved in a second direction that is apart from the flow channel unit.

11 Claims, 17 Drawing Sheets

LIQUID EJECTING APPARATUS

BACKGROUND

1. Technical Field

The present invention relates to a liquid ejecting apparatus which is provided with a cartridge holder attaching section on which a plurality of cartridge holders for holding a cartridge storing liquid such as ink are attached.

2. Related Art

In related art, as a typical example of a liquid ejecting apparatus, an ink jet recording apparatus having a recording head that performs printing by discharging ink droplets to a recording media from nozzles has been widely used.

The recording apparatus is provided with a carriage and a recording head loaded on the carriage and performs printing on the recording media by discharging the ink droplets from the nozzles formed on the recording head while shifting the carriage relative to the recording media.

There is widely used a recording apparatus having a plurality of cartridge holders provided therein for housing and holding a plurality of ink cartridges storing print ink (for example, see JP-A-2006-116793).

The ink cartridges may house an ink pack storing the ink in a cartridge case. Pressurization air is applied into the cartridge case and thus, the ink pack is placed under pressure, whereby the ink is ejected from an ejection member (an ink supply needle) and is supplied to the recording head.

For example, as shown in FIG. 16, cartridge holders 100 housing the ink cartridges have a substantially rectangular thin packing body 101 and an ink cartridge housing space housing the ink cartridges therein. In the cartridge holders 100 shown in FIG. 16, a plurality of (here, for example, three packing bodies) packing bodies 101 each have one side surface opened and are laminated and mounted with a side plate 102 to form three cartridge housing spaces. Openings 103 for attaching and detaching the ink cartridges are provided on a front surface (a right inner side surface in FIG. 16) of each cartridge holder 100. On rear walls 104 of the cartridge holders 100, there are provided holding portions 105 for holding air supply members for introducing air in the ink cartridges or holes 106 holding the ink supply needle for emitting the ink from the ink cartridges.

However, as shown in FIG. 17, a plurality of cartridge holders 100 shown in FIG. 16 are laminated and integrally used so as to house ink cartridges each storing ink of different colors and have the wrong insertion prevention structure for allowing only ink cartridges of predetermined colors to be mounted for each cartridge holder 100. Accordingly, mutual attaching positions of the cartridge holders 100 are also predetermined so as to supply ink of a correct color to a recording head of a recording apparatus. As a result, as shown in FIG. 16, locking claws 107 and locking concave portions 108 are provided at different positions of each of the cartridge holders 100 so as not to attach the cartridge holders 100 in an order other than a proper lamination order.

In a bottom cartridge holder 100 shown in each of FIGS. 16 and 17, a locking claw 107A for locking the cartridge holder 100 above the bottom cartridge holder 100 (a second step from the downside) is provided, and in a second-step cartridge holder 100, a locking concave portion 108B with which only the bottom locking claw 107A can engage is provided. In the second-step cartridge holder 100, a locking claw 107B for locking a third-step cartridge holder 100 is provided, and in the third-step cartridge holder 100, a locking concave portion 108C with which only the second-step locking claw 107B can engage is provided.

Similarly, in the third-step cartridge holder 100, the locking claw 107C for locking the third-step cartridge holder 100 is provided, and a locking concave portion 108D with which only the third-step locking claw 107C can lock is provided. A plurality of cartridge holders in a state shown in FIG. 17 are mounted and used integrally with a flow channel unit having ink flow channels.

By this configuration, the cartridge holders 100 can be relatively attached on and detached from each other only in a vertical direction. As a result, as shown in FIG. 17, assuming that a cartridge holder 100 in the middle (in a center) of a plurality of integrated cartridge holders 100 breaks down, it is difficult to directly take out only the broken cartridge holder 100.

Assuming that one cartridge holder is removed, complicated steps for removing all cartridge holders from the flow channel unit on which the plurality of cartridge holders are attached and disassembling them into individual cartridge holders are required, which is inconvenient.

SUMMARY

An advantage of some aspects of the invention is to provide a liquid ejecting apparatus in which even a middle cartridge holder can be individually taken out from a structure of the plurality of cartridge holders on which the cartridge holders are mounted in parallel.

An aspect of the invention provides a liquid ejecting apparatus comprising: a flow channel unit, having a liquid flow channel for supplying a liquid stored in a liquid cartridge; and a plurality of cartridge holders, including a first cartridge holder and a second cartridge holder adjacent to each other, and attached to the flow channel unit while the cartridge holders are arranged in a first direction, each of the cartridge holders adapted to hold the liquid cartridge and having a first engaging portion and a second engaging portion, wherein the first engaging portion of the first cartridge holder and the second engaging portion of the second cartridge holder are engageable with each other to lock the first and second cartridge holders, and the first engaging portion of the first cartridge holder and the second engaging portion of the second cartridge holder are disengageable from each other to unlock the first and second cartridge holders when one of the first and second cartridge holders is moved in a second direction that is apart from the flow channel unit.

In the recording apparatus configured above, the plurality of cartridge holders are attached to the flow channel unit having the liquid flow channels and air flow channels formed therein with the adjacent cartridge holders locked by the first engaging portion and the second engaging portion.

In the first engaging portion and the second engaging portion, the adjacent cartridge holders are locked with each other in a state where the cartridge holders are slidable in an attaching direction to the flow channel unit and in the opposite direction so as to movably guide the cartridge holders. Accordingly, even when any one of the plurality of cartridge holders is removed, it is possible to individually move and remove an arbitrary cartridge holder in a direction (that is, a removing direction) distant from the flow channel unit with other cartridge holders remaining attached to the flow channel unit. By this configuration, a procedure of removing all the cartridge holders from the flow channel unit on which the plurality of cartridge holders are mounted and disassembling them into individual cartridge holders in the related art are not required, whereby workability is improved.

It is preferable that the first engaging portion and the second engaging portion are disposed on a side apart from the flow channel unit since the cartridge holders are attached to the flow channel unit.

When at least one of the first engaging portion and the second engaging portion of the second cartridge holder is protruded toward the first cartridge holder, the first cartridge holder may preferably include a notch that has a depth larger than a protrusion height of the at least one of the first engaging portion and the second engaging portion of the second cartridge holder. The notch is positioned to a side of the flow channel unit with respect to at least one of the second engaging portion and the first engaging portion of the first cartridge holder, and the at least one of the first engaging portion and the second engaging portion of the second cartridge holder can pass therethrough in a direction perpendicular to the first direction.

In this case, the arbitrary cartridge holder is slightly moved in the removing direction when the plurality of cartridge holders are locked with each other and then, the arbitrary cartridge holder can be moved in a direction perpendicular to the removing direction, whereby even the middle cartridge holder adjacent both the upper and lower other cartridge holders can be easily taken out individually. Shapes of the side walls are designed so that the cartridge holders do not interfere with each other in the overall attachment direction length when assuming that the amount of movement required for removal extends throughout the overall attachment direction length of the cartridge holders. In accordance with this configuration, movement in the attachment direction is finished in a short movement, and design flexibility of the cartridge holders is improved. Further it is preferable that the first engaging portion is a locking claw which is provided at a first end portion in the first direction, and the second engaging portion is a receiving portion which protrudes from a second end portion opposing the first end portion in the first direction and which engages with the locking claw, since simple structure can be achieved.

It is preferable that the receiving portion has: a receiving piece of an L shape which protrudes from a wall surface; and a protrusion which is disposed on an open side of the receiving piece that blocks a movement of the locking claw engaging with the receiving portion toward the open side.

In the locking mechanism configured above, since the cartridge holders can be supported in parallel by the receiving piece and movements of the locking claws in a direction (a width direction of the cartridge holder) perpendicular to the attachment direction can be prevented by the protrusions, deformation such as inward fall-down of the side walls of the cartridge holders can as inward fall-down of the side walls of the cartridge holders can be prevented without movement of the locking claws in the width direction of the cartridge holder when the locking claws are locked with the receiving portions. Since the protrusions can be smaller than the receiving pieces, the protrusions can also pass through the notches with the receiving pieces. Accordingly, it becomes possible to take out the cartridge holders in a transverse direction.

An identification mechanism that allows the cartridge holder to be attached to the flow channel unit when the cartridge holder is disposed on a predetermined position of the flow channel unit and does not allow the cartridge holder to be attached to the flow channel unit when the cartridge holder is disposed on a position other than the predetermined position of the flow channel unit may be further provided.

In addition, it is preferable that the identification mechanism comprises an identification engaging portion of the cartridge holder and an identification engaging portion of the flow channel unit at a face at which the cartridge holder and the flow channel unit are opposed to each other, and each of the cartridge holders has the identification engaging portion that is different from those of the other cartridge holders.

Even if each of the cartridge holders is attached to a position other than the predetermined position of the flow channel unit, it is possible to prevent false attachment of each of the cartridge holders. It is possible to easily manufacture different cartridge holders by exchanging only a part corresponding to an identifying concave-convex portion in a die at the time of molding each of the cartridge holders. Consequently, since a dedicated die is not required to be provided for each of the cartridge holders, a decrease in manufacturing costs can bereduced.

It is preferable that the cartridge holder is prevented from being attached to the flow channel unit by an interference of the identification engaging portion of the flow channel unit that allows one of the other cartridge holders to be attached thereto when the cartridge holders are disposed at a position other than the predetermined position of the flow channel unit since each of the cartridge holders cannot be attached to the position other than the predetermined position of the flow channel unit by an interference of the identifying engaging portion of each cartridge holder and the identifying engaging portion of the flow channel unit even when intending to attach each of the cartridge holders to the position other than the predetermined position of the flow channel unit.

It is preferable that the identification mechanism comprises a combination of a plurality of protrusions. In addition, the identification engaging portion of the cartridge holder has a plurality of protrusions arranged in a different manner from the other cartridge holders, and the identification engaging portion of the flow channel unit has at least one protrusion provided at a position which does not interfere with only the protrusions of the cartridge holder to be attached thereto.

In the attaching structure of the cartridge holders configured above, the identifying mechanism is constituted by the plurality of protrusions, and thus the position of the cartridge holder and the position of the flow channel unit correspond to each other by changing combination structures (positions or shapes) of the holder protrusions and the flow channel protrusions, whereby it is possible to easily manufacture different cartridge holders just by changing a die component in a part in which the protrusions are formed at the time of molding each of the cartridge holders.

BRIEF DESCRIPTION OF THE DRAWINGS

These and other aspects will be described with reference to the accompanying drawings, wherein like numbers reference like elements.

DESCRIPTION OF EXEMPLARY EMBODIMENTS

Hereinafter, an exemplary embodiment of a liquid ejecting apparatus which is provided with a cartridge holder will be described with reference to the accompanying drawings.

In the exemplary embodiment, a case in which a liquid ejecting apparatus is applied to a publisher as a media processing apparatus is exemplified.

Figure 1:
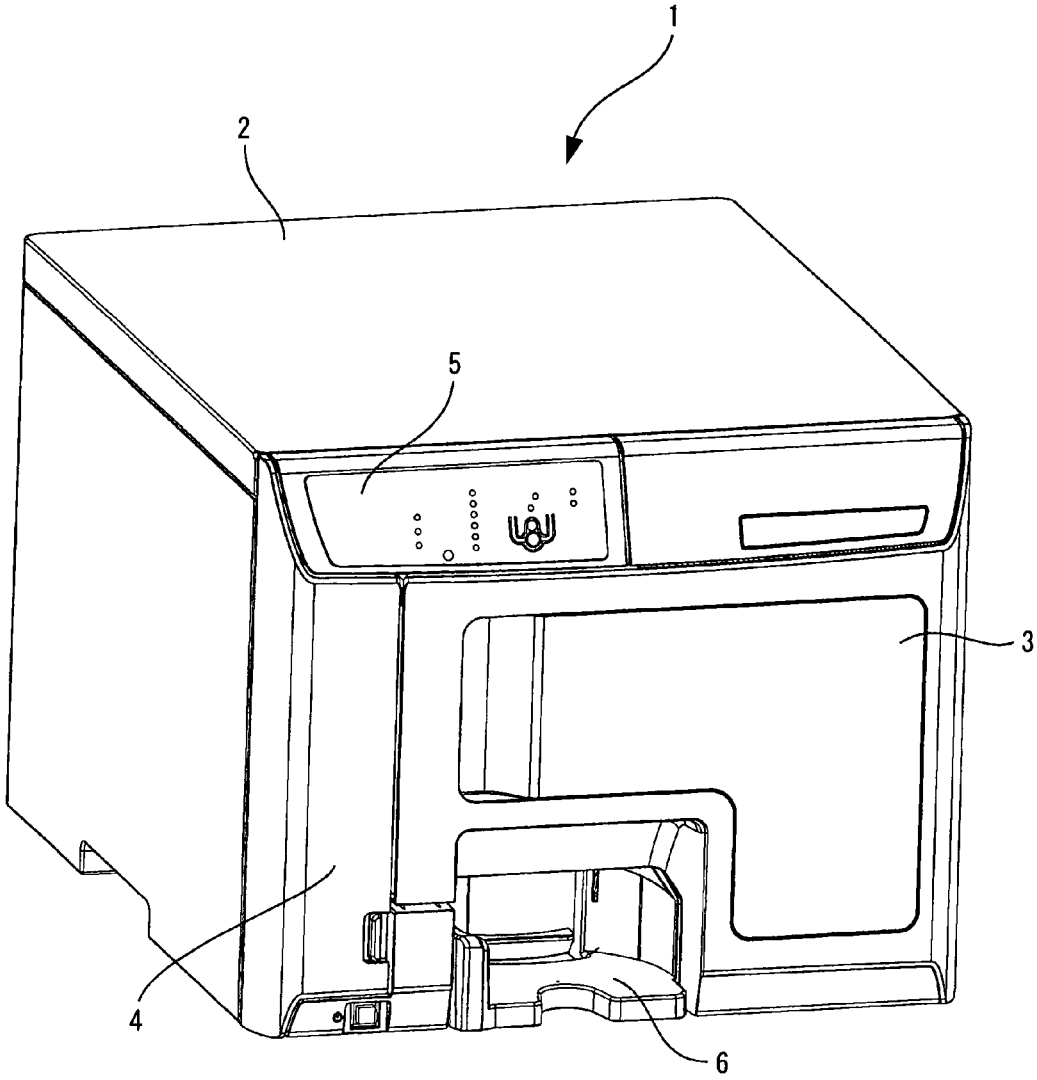
FIG. 1 is an external perspective view of a publisher (a media processing apparatus) to which a liquid ejecting apparatus according to an exemplary embodiment of the present invention is applied.
Figure 2:
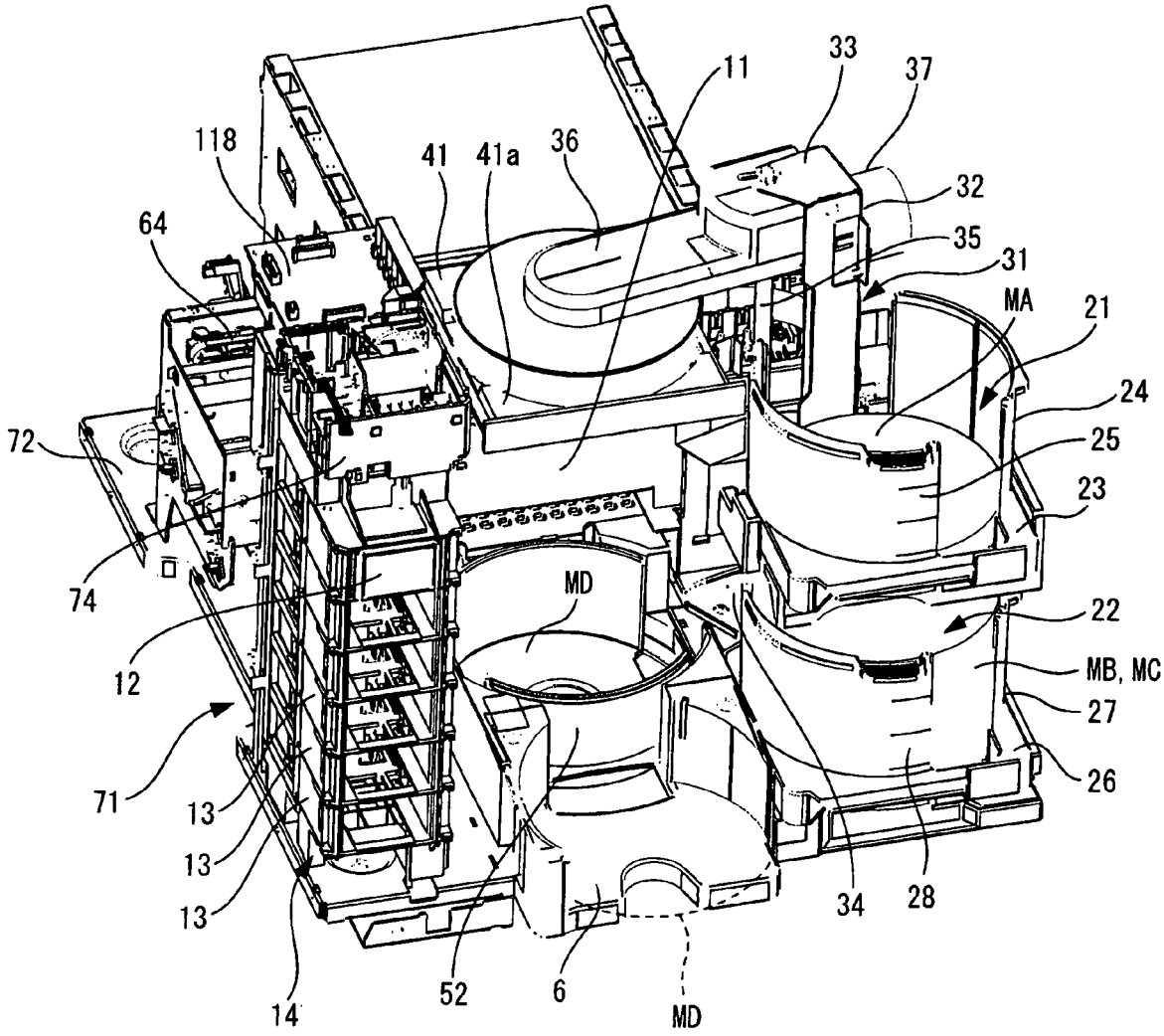
FIG. 2 is a perspective view illustrating a state in which a case of a publisher is removed as viewed from a front side.
Figure 3:
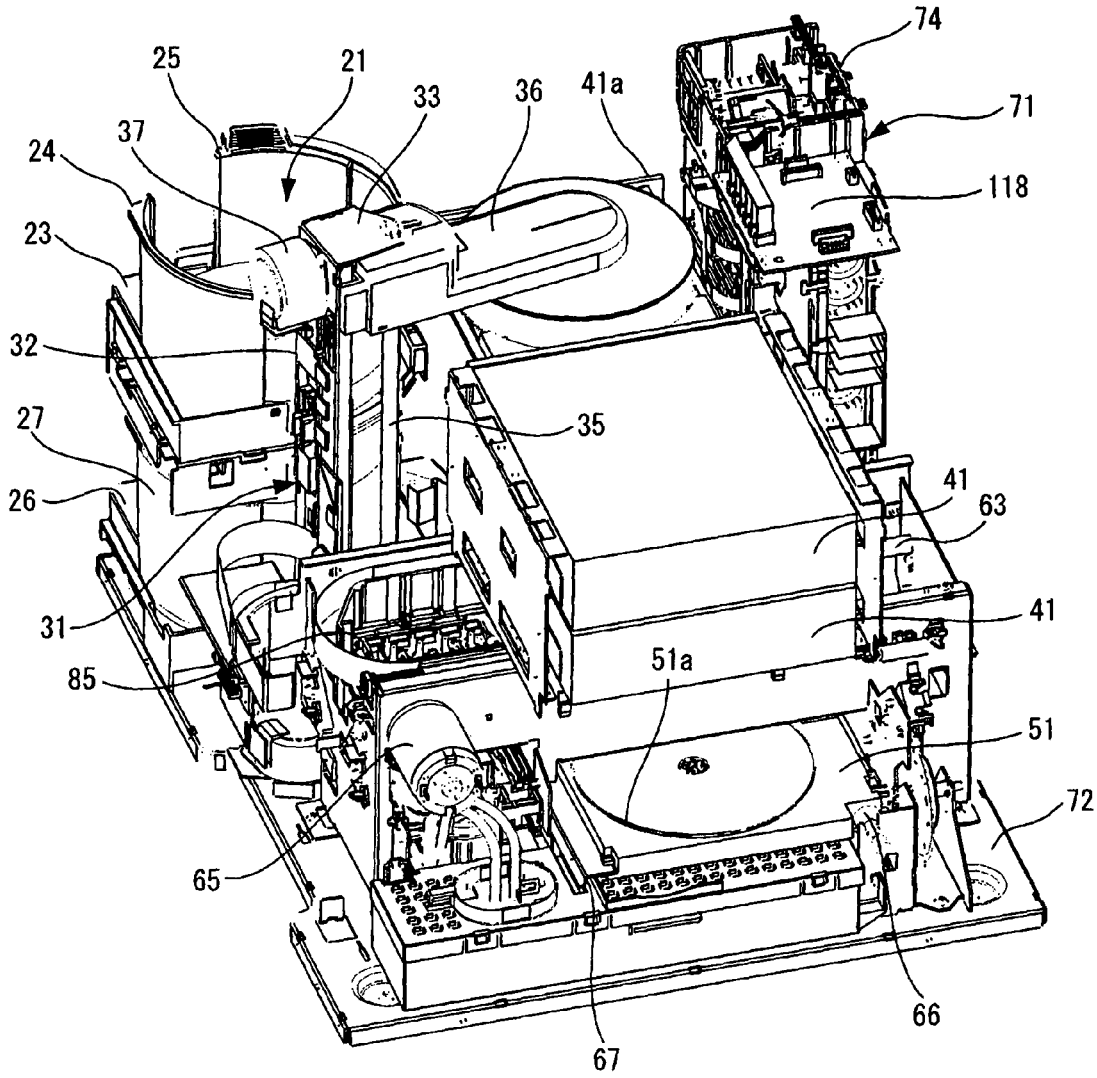
FIG. 3 is a perspective view illustrating a state in which a case of a publisher is removed as viewed from a rear side.
Figure 4:
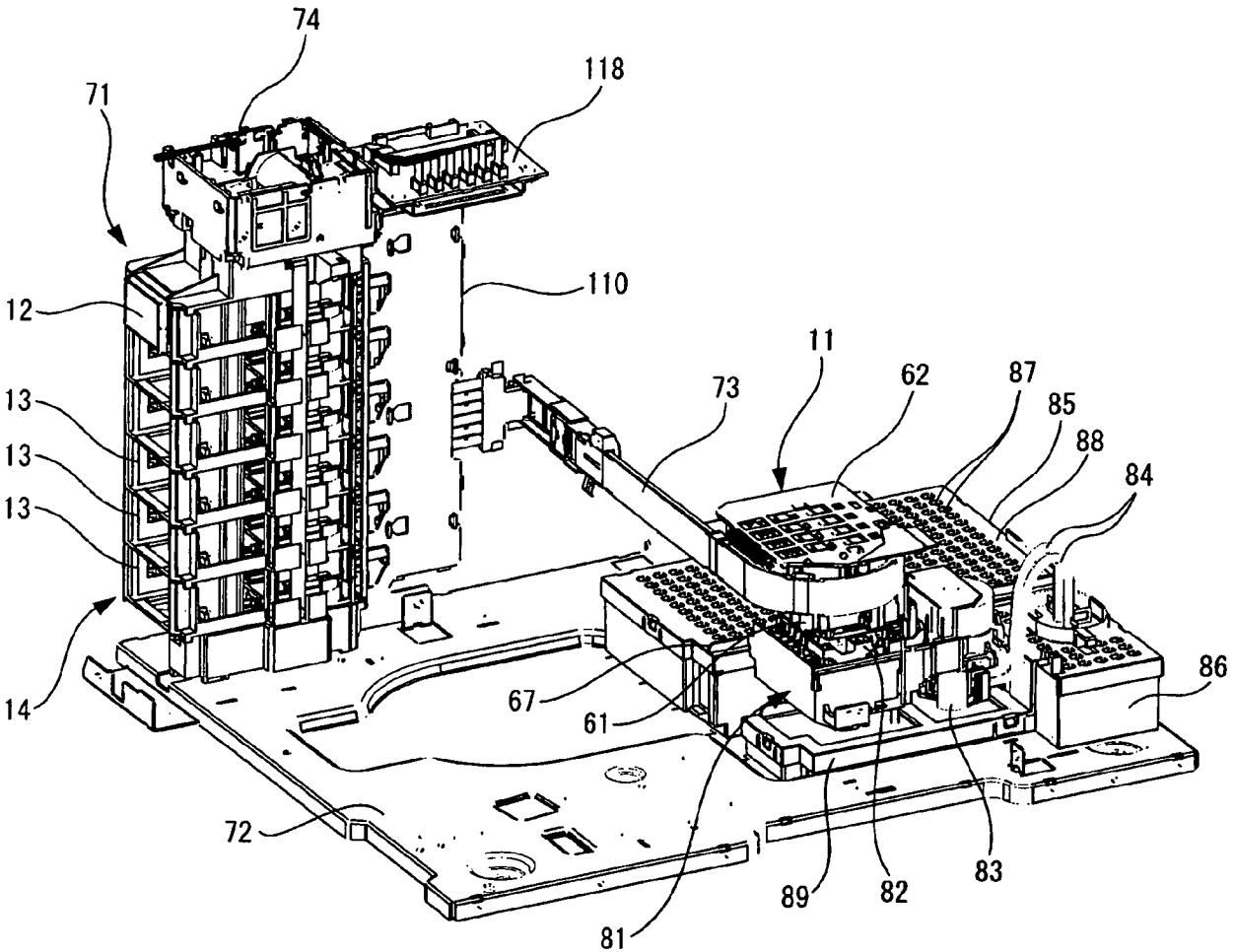
FIG. 4 is a perspective view of a liquid ejecting apparatus installed in a publisher.
Figure 5:
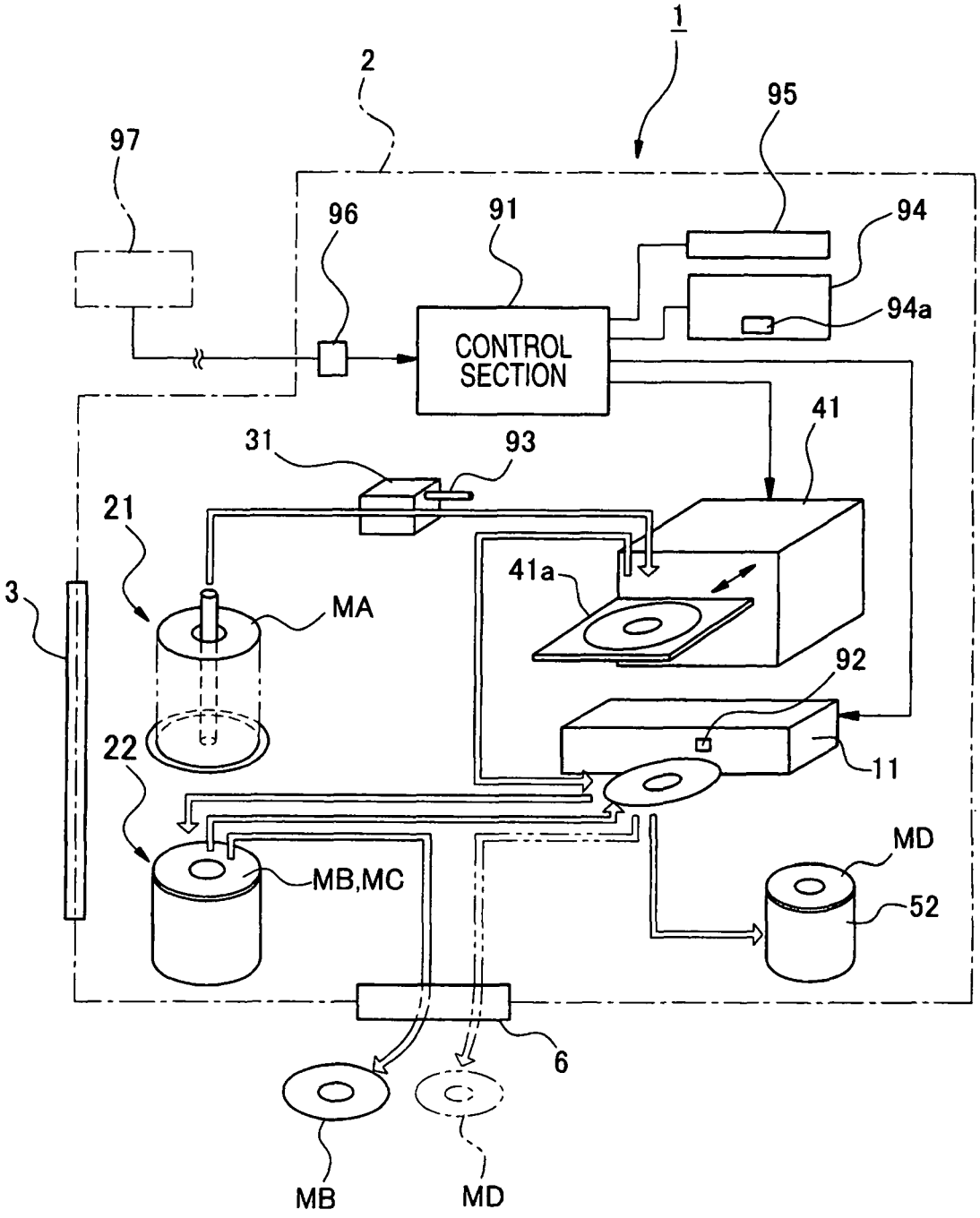
FIG. 5 is an internal schematic configuration diagram of a publisher.

FIG. 1 is an external perspective view of the publisher (the media processing apparatus), FIG. 2 is a perspective view of the publisher of which case is removed as viewed from the front side, FIG. 3 is a rear perspective view of the publisher of which case is removed, FIG. 4 is a perspective view of the liquid ejecting apparatus installed in the publisher, and FIG. 5 is an internal schematic configuration diagram of the publisher.

A publisher 1 is the media processing apparatus performing writing data in disk-like media such as CDs and DVDs and printing on label surfaces of the media. The publisher 1 is provided with a substantially rectangular parallelepiped-shaped case 2. Sliding doors 3 and 4 which can be opened and closed in a lateral direction are attached onto a front surface of the case 2. An operation surface 5 having display lamps, operation buttons, and the like arranged thereon is provided in an upper right end portion of the case 2, and a media discharge port 6 is provided in a lower end of the case 2.

The right sliding door 3 is locked in a closed state, and a biometric reading section (not shown) such as a fingerprint sensor is disposed on the operation surface 5 as viewed from a front side, whereby only a person which is registered beforehand can open and close the right sliding door 3. The sliding door 3 can be opened and closed even by a command received from a superior apparatus 97 (see FIG. 5) (to be described later) communicably connected with the publisher 1.

As shown in FIG. 2, the left sliding door 4 is opened at the time of exchanging an ink cartridge 12 of a label printer (a liquid ejecting apparatus) 11 as viewed from a front side, and when the sliding door 4 is opened, a cartridge attaching section 14 having a plurality of cartridge holders 13 arranged in a vertical direction is exposed.

As shown in FIG. 3, a blank media storing section 21 capable of stacking a plurality of sheets of unused blank media MA in which data writing processing is not performed, and a prepared media storing section 22 in which prepared media MB are stored are vertically disposed on the same shaft in the case 2 of the publisher 1. When media MC which is unnecessary is disposed, the unnecessary media MC is set in the prepared storing section 22.

The blank media storing section 21 is provided with a slide plate 23 which can be drawn out horizontally to the front side and a pair of right and left circular-shaped frame plates 24 and 25 which are disposed vertically on the slide plate 23. The slide plate 23 and the pair of frame plates 24 and 25 constitute a stacker which can receive the blank media MA from above and house the blank media MA while laminating it on the same shaft. Housing the blank media MA in the blank media storing section 21 or replenishing the blank media storing section 21 with the blank media MA can be easily performed by opening the sliding door 3 and drawing out the slide plate 23.

The lower prepared media storing section 22 also has the same structure as the blank media storing section 21 and is provided with a slide plate 26 which can be drawn out horizontally to the front side and a pair of right and left circular-shaped frame plates 27 and 28 which are disposed vertically on the slide plate 26. The slide plate 26 and the pair of frame plates 27 and 28 constitute a stacker which can receive the prepared blank media MA or the unnecessary media MC from above and house the blank media MA or the unnecessary media MC while laminating it on the same shaft.

A disposal action may be performed by opening the sliding door 3 and setting the unnecessary media MC in the prepared media storing section 22 at the time of disposing the unnecessary media MC. The prepared media MB (that is, media in which writing of data and printing on the label surface are finished) may be taken out from the sliding door 3.

A media transporting mechanism 31 is disposed in the rear of the blank media storing section 21 and the prepared media storing section 22. The media transporting mechanism 31 is provided with a chassis 32 vertically attached to the case 2, a vertical guide shaft 35 extending vertically between horizontal supporting plate sections 33 and 34 above and below the chassis 32, and a media carrier 36 attached to the vertical guide shaft 35. The media carrier 36 can move up and down along the vertical guide shaft 35 by a driving motor 37, and the media carrier 36 can turn right and left on the vertical guide shaft 35. Media transported to the media discharge port 6 by the media transporting mechanism 31 can be taken out from the media discharge port 6 to the outside.

Two media drives 41 laminated vertically are disposed in lateral parts of the upper and lower storing sections 21 and 22, and the media transporting mechanism 31 and a carriage 62 (see FIG. 4) of a label printer 11 (to be described later) is movably disposed below the media drives 41.

The media drives 41 each have media trays 41*a* which can move between a position at which the data are written in the media and a media receipt position at which the media are delivered and received.

The label printer 11 has a media tray 51 which can move between a position at which label printing can be performed onto the media label surface and the media receipt position at which the media are delivered and received.

In FIGS. 2 and 3, the media tray 41*a* of the upper media drive 41 is drawn out forward and is placed at the media receipt position, and the media tray 51 of the lower label printer 11 is placed at an inner position at which the label printing can be performed. The label printer 11 is preferably an ink jet printer. Ink cartridges 12 corresponding to various colors (six colors such as black, cyan, magenta, yellow, light cyan, and light magenta) are used as an ink supplying mechanism 71, and the ink cartridges 12 are mounted on the cartridge holders 13 of the cartridge attaching section 14 from the front side.

Gaps in which the media carrier 36 of the media transporting mechanism 31 can move up and down are formed between a pair of right and left frame plates 24 and 25 of the blank media storing section 21 and between a pair of right and left frame plates 27 and 28 of the prepared media storing section 22. The media carrier 36 of the media transporting mechanism 31 turns horizontally between the upper and lower blank media storing section 21 and the prepared media storing section 22, and the gaps are positioned so that the media carrier 36 can be positioned just above the prepared media storing section 22. When the media tray 41*a* is pushed into the media drive 41, the media carrier 36 of the media transporting mechanism 31 moves down and thus, it is accessible to the media tray 51 placed at the media receipt position. Accordingly, the media can be transported to each section by a combination of actions of moving up and down and turning right and left of the media carrier 36.

A disposal stacker 52 for storing disposal media MD is disposed below the media receipt position of the media tray 51, and approximately 30 sheets of disposal media MD can be stored in the disposal stacker 52. The disposal media MD can be supplied to the disposal stacker 52 by the media carrier 36 of the media transporting mechanism 31 while the media tray 51 is retreated to a data writing position from the media receipt position above the disposal stacker 52.

By this configuration, the media including the CD or the DVD are transported among the blank media storing section 21, the prepared media storing section 22, the disposal stacker 52, the media tray 41*a* of the media drive 41, and the media tray 51 of the label printer 11 by the media carrier 36 of the media transporting mechanism 31.

A media disposal mechanism 92 (see FIG. 5) is attached to a front side of the label printer 11. The media disposal mechanism 92 protrudes a protruding portion with a driving mechanism such as a plunger, contacts the protruding portion with media loaded on the media tray 51 which moves back and forth, and mechanically destroys recording surfaces of the media to disable writing and reading.

Next, a configuration of the label printer 11 will be described.

As shown in FIGS. 2 to 4, the label printer 11 is provided with the carriage 62 having an ink jet head 61 supported to reciprocate horizontally along a carriage guide shaft 63. The carriage 62 is provided with a timing belt 64 extending horizontally along the carriage guide shaft 63 and a carriage motor 65 for driving the timing belt 64.

A nozzle surface of the ink jet head 61 loaded on the carriage 62 is inclined downward, and the media tray 51 can reciprocate back and forth horizontally below the ink jet head 61. A right end of the media tray 51 is supported by a guide shaft 66 extending back and forth horizontally, and a left end of the media tray 51 is supported by a guide rail 67 slidably extending back and forth horizontally. A driving mechanism of the media tray 51 is also provided with a timing belt (not shown) extending back and forth horizontally and a tray motor for driving the timing belt not shown.

The label printer 11 is provided with the ink supplying mechanism 71 having a cartridge attaching section 14 on which the ink cartridges 12 are mounted. The ink supplying mechanism 71 has a vertical structure. The ink supplying mechanism 71 is supported and placed in a vertical direction on a base 72 of the publisher 1. One end of a flexible ink supplying tube 73 is connected to the ink supplying mechanism 71, and the other end of the ink supplying tube 73 is connected to the carriage 62.

Ink of the ink cartridges 12 of the ink supplying mechanism 71 is supplied to the carriage 62 through the ink supplying tube 73, and the ink is supplied to the ink jet head 61 through a damper unit and a back-pressure regulating unit (not shown) which are provided in the carriage 62.

A pressurizing mechanism 74 is provided above the ink supplying mechanism 71. The pressurizing mechanism 74 pressurizes the ink cartridges 12 and discharges ink accumulated in ink packs of the ink cartridges 12.

An ink absorbing mechanism 81 is provided below a home position (a position shown in FIG. 4) of the carriage 62. The ink absorbing mechanism 81 is provided with a cap 82 covering the nozzle of the ink jet head 61 exposed to a lower surface of the carriage 62 disposed at the home position and a waste ink absorbing pump 83 absorbing waste ink discharged to the cap 82 by a head cleaning action of the ink jet head 61 or an ink filling action of the ink jet head 61.

The waste ink absorbed by the waste ink absorbing pump 83 of the ink absorbing mechanism 81 is fed to a waste ink absorbing tank 85 through a tube 84.

In the waste ink absorbing tank 85, an absorber (not shown) is placed in a case 86, and a top surface of the waste ink absorbing tank 85 is covered with a cover 88 having a plurality of hole portions 87.

A waste ink receiving section 89 as a part of the waste ink absorbing tank 85 is provided below the waste ink absorbing mechanism 81. The waste ink receiving section 89 receives the waste ink dripped from the waste ink absorbing mechanism 81 and absorbs the waste ink with the absorber.

The media tray 51 is provided with a circular shallow concave portion 51*a* for loading the media on a top surface of a rectangular plate thereof. Three vertical claws (not shown) concentrically disposed a 120 degree interval are provided in a center of the concave portion 51*a*. Two vertical claws of three vertical claws can integrally move in a radial direction, and one vertical claw is disposed at a fixed position. Two vertical claws can be moved by a driving mechanism such as an electronic solenoid (not shown).

When the media are dropped to the concave portion 51*a* from above with a label surface on which a label is printed facing up, three vertical claws are inserted into center holes of the media. Thereafter, when two vertical claws are slightly moved to the outside in the radial direction, the three vertical claws are tightly pressed against inner peripheral surfaces of the center holes of the media from the inside. By this configuration, the media are held in the media tray 51. In this state, the media tray 51 is moved to a rear side along the guide shaft 66 by driving a tray motor (not shown) and thus, it can be moved to a printing area of the ink jet head 61. Thereafter, predetermined printing can be performed on the label surfaces of the media by the ink jet head 61.

The waste ink absorbing tank 85 is disposed below the printing area of the ink jet head 61, and the ink dripped from the ink jet head 61 is received by the waste ink absorbing tank 85.

Next, an internal configuration of the publisher 1 will be described.

As shown in FIG. 5, the publisher 1 includes a central control part which has a control section 91 conducting control of each section and performs operation control between the sections in the publisher 1. Specifically, the central control part controls operations of the media drive 41, the label printer 11, and the media transporting mechanism 31.

The publisher 1 is provided with a media disposal mechanism 92 for disposing the unnecessary media MC which becomes unnecessary after preparation in a state of inability to write and read the data in addition to a function for preparing the media, an image sensor 93 formed of a line sensor having a CCD for reading print images on the label surfaces of the unnecessary media MC disposed by the media disposal mechanism 92, and a storage section 94 for storing the print images of the read label surfaces as a media disposal history 94*a* by the media disposal mechanism 92.

As described above, the media disposal mechanism 92 mechanically damages recording surfaces of the unnecessary media MC by using movement of the media tray 51 in the label printer 11 and thus, it changes the unnecessary media MC to the waste media MD in which reading and writing of the data is disabled.

The image sensor 93 for reading the print images on the label surfaces is loaded on the media transporting mechanism 31, for example. All the print images of the label surfaces are read by the image sensor 93 disposed in the radial direction of the media with a light receiving surface facing the label surfaces of the media MC by rotating the unnecessary media MC gripped to the media transporting mechanism 31. Alternatively, all the print images of the label surfaces may be read by rotating the image sensor 93 disposed in the radial direction of the media on the label surfaces of the unnecessary media MC gripped to the media transporting mechanism 31.

An operating section 95 is connected to the control section 91, and alphanumeric key groups such as numeric keys for inputting authentication passwords, various function key groups, and indicator groups such as status display lamps are disposed in the operating section 95. The control section 91 is connected to the main apparatus 97 through a communication interface 96 by dedicated communication lines or general communication lines. In general, media preparing actions (a data writing action and a label surface printing action), a media disposal history preparing action (a label surface print image reading action), and a media disposal action come to start based on a media preparation command, a media disposal command, and the like supplied to the control section 91 from the main apparatus 97.

Next, a detailed structure of the ink supplying mechanism 71 constituting the label printer 11 in the publisher 1 will be described.

Figure 6:
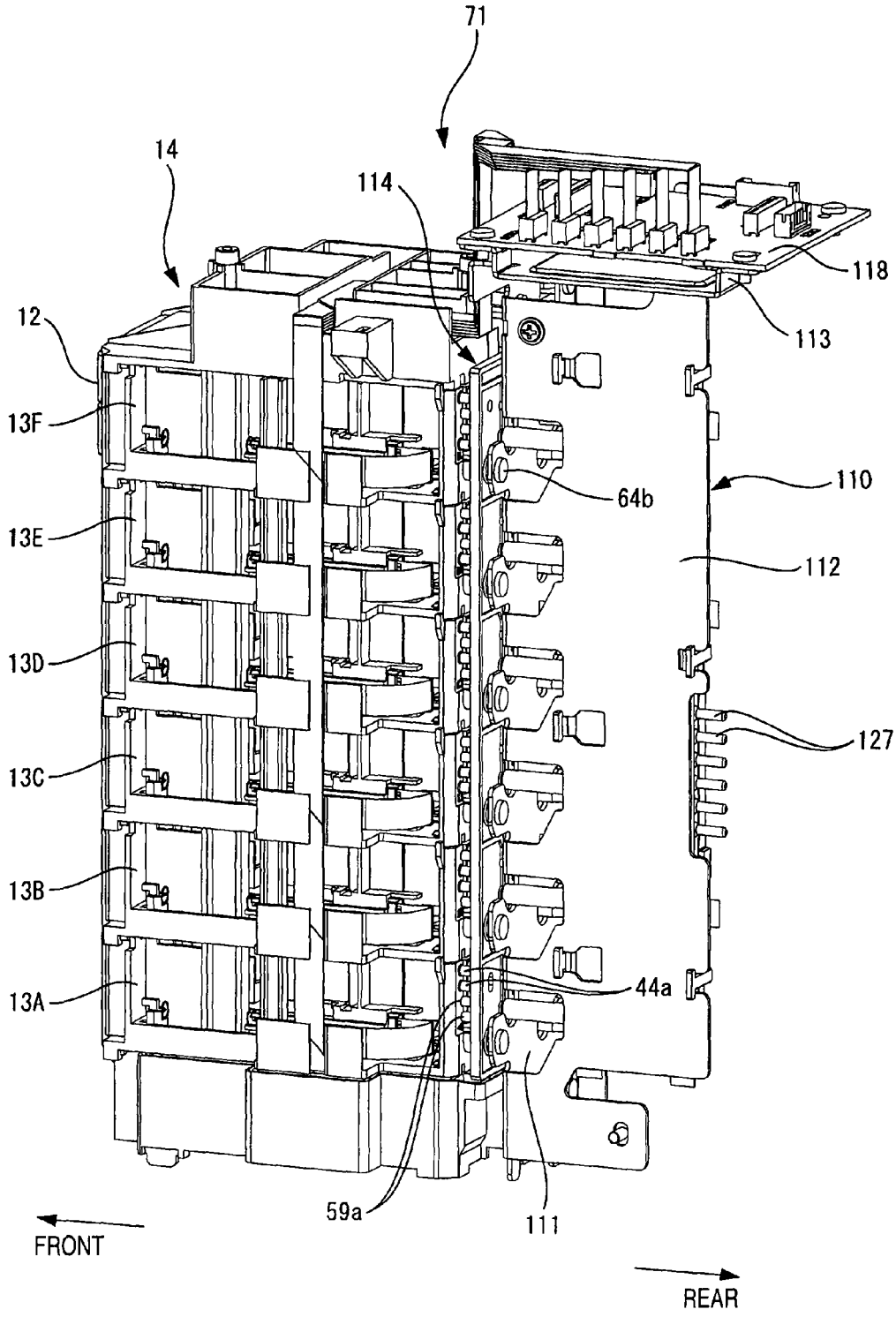
FIG. 6 is a perspective view of an ink supplying mechanism part as viewed from a side.
Figure 7:
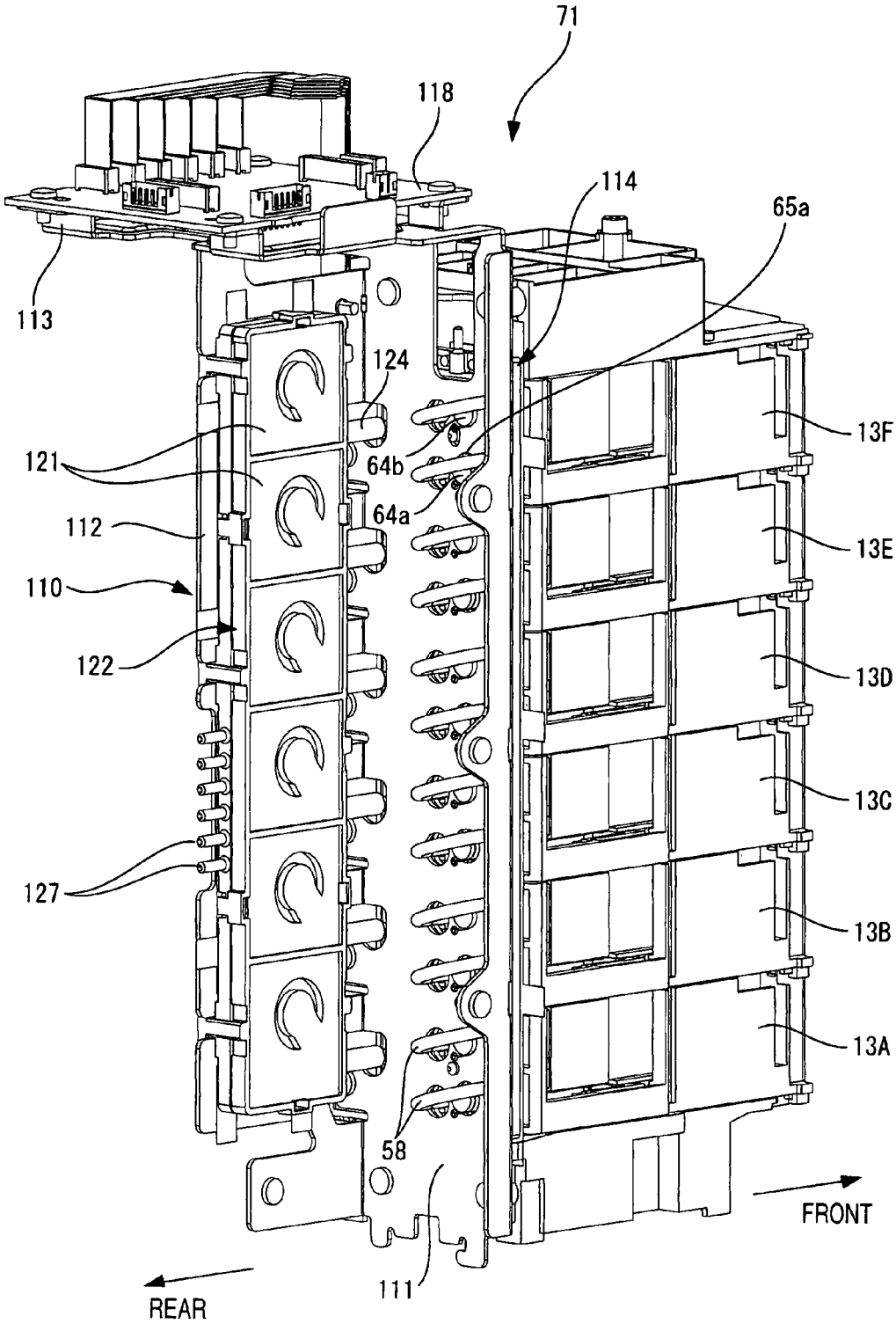
FIG. 7 is a perspective view of an ink supplying mechanism part in a rear view.
Figure 8:
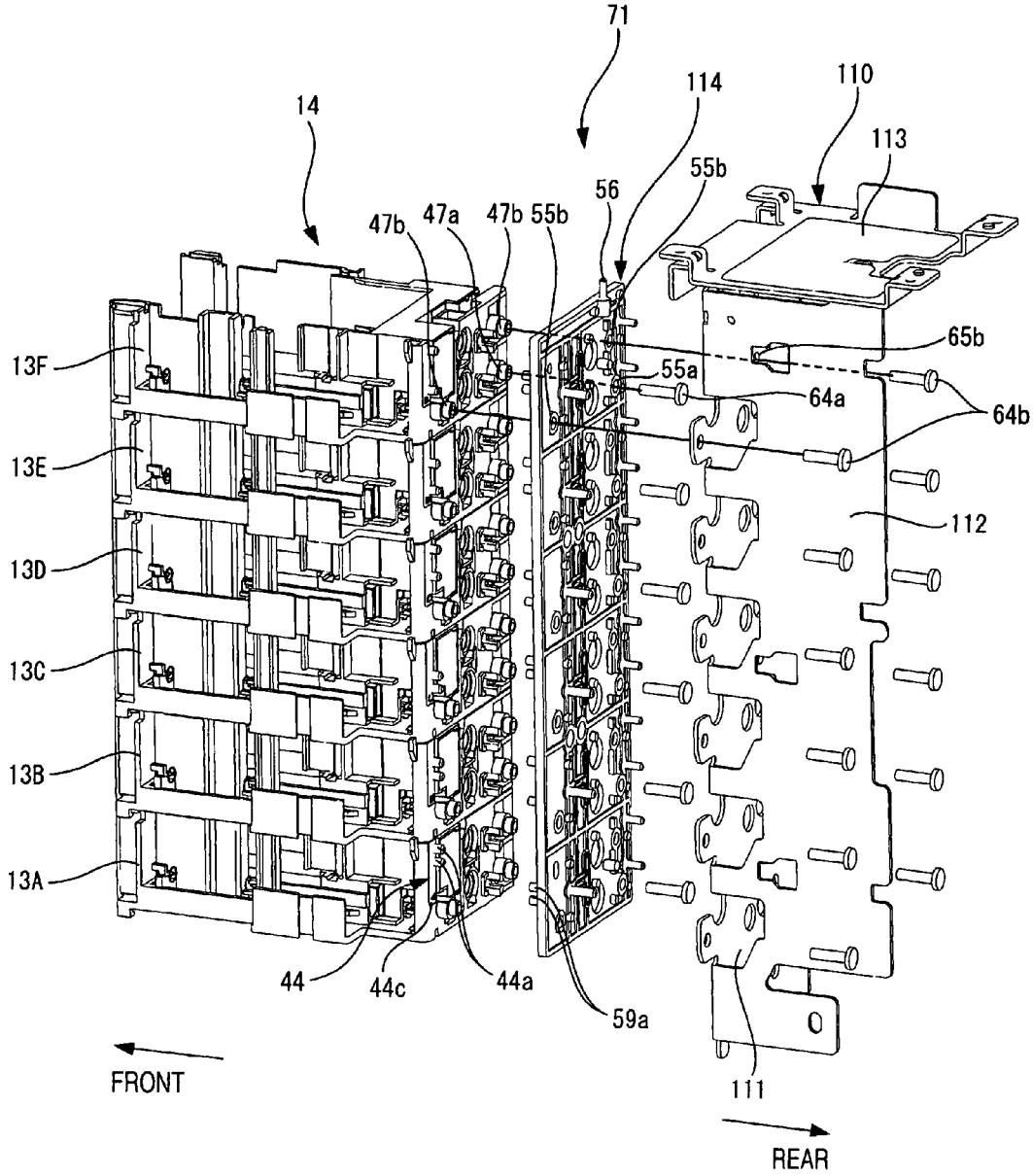
FIG. 8 is an exploded perspective view of an ink supplying mechanism part.
Figure 9:
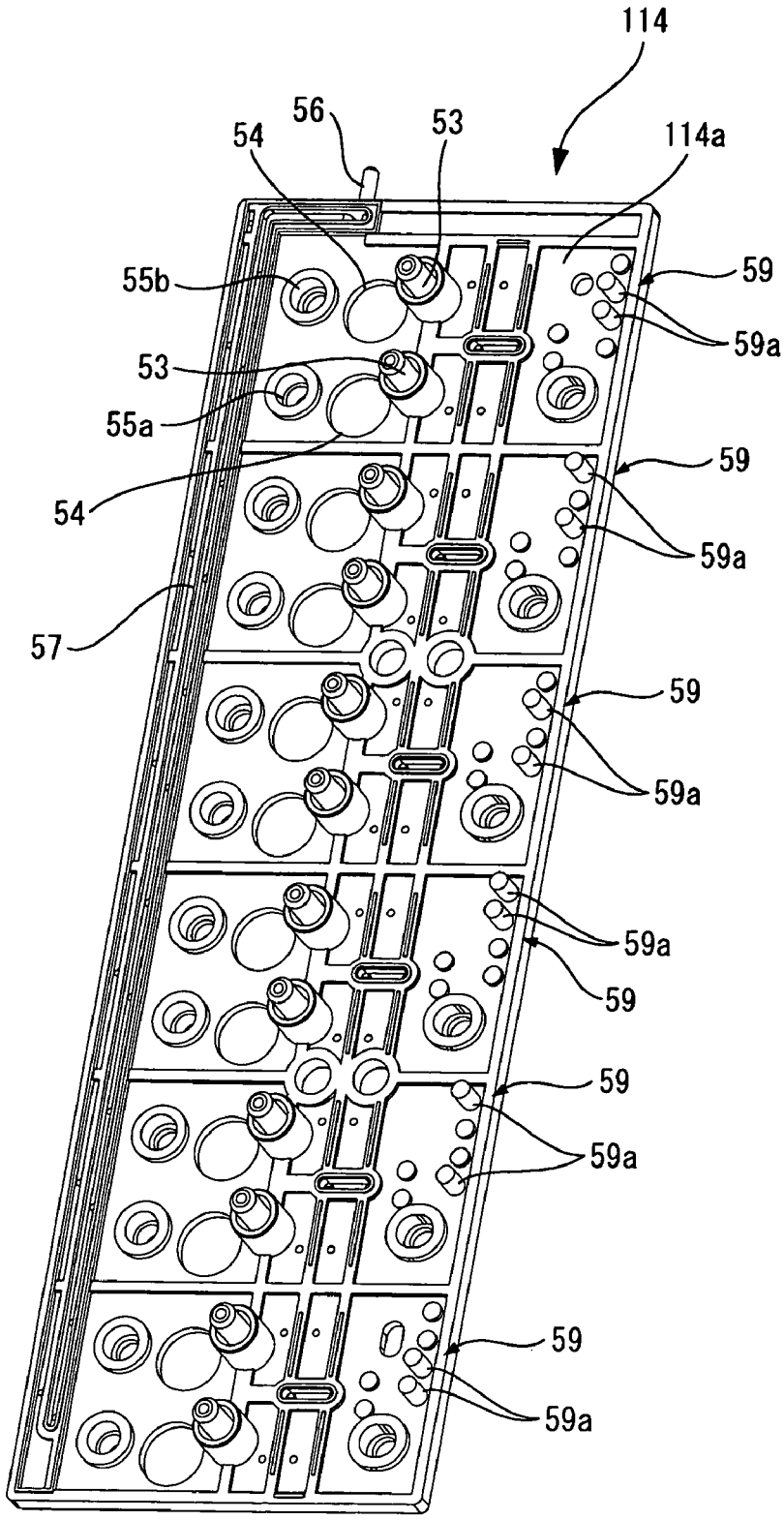
FIG. 9 is a perspective view of a flow channel unit as viewed from a front side.
Figure 10:
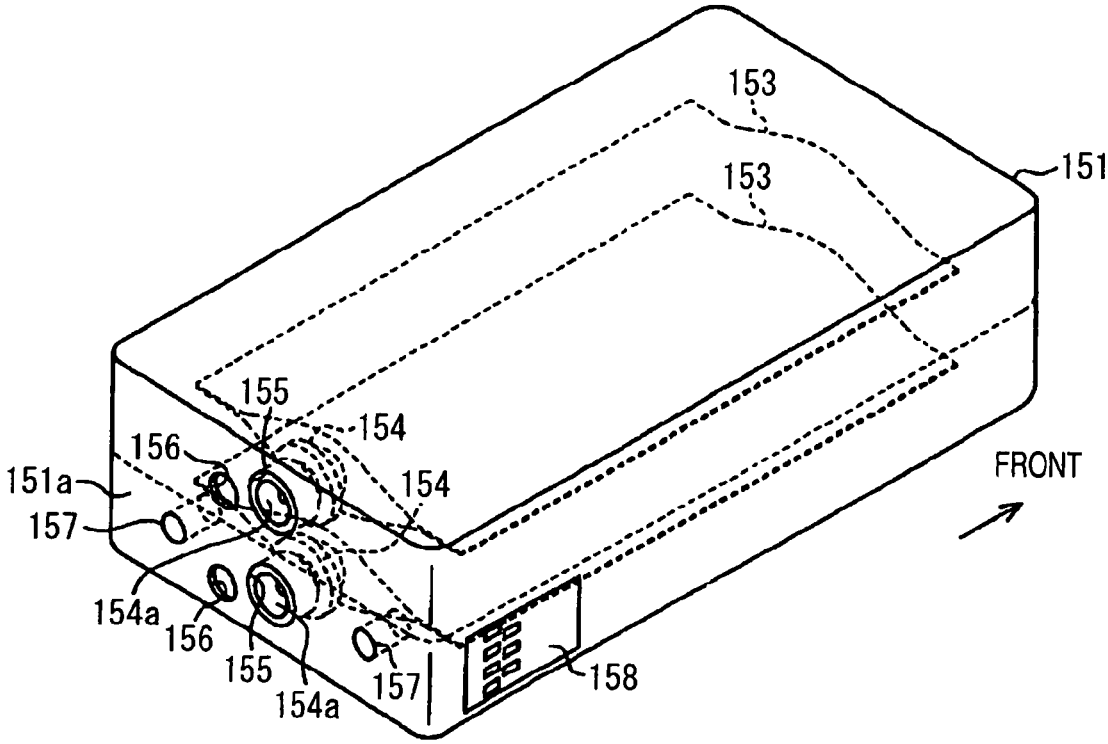
FIG. 10 is a perspective view illustrating an example of an ink cartridge.
Figure 11A:
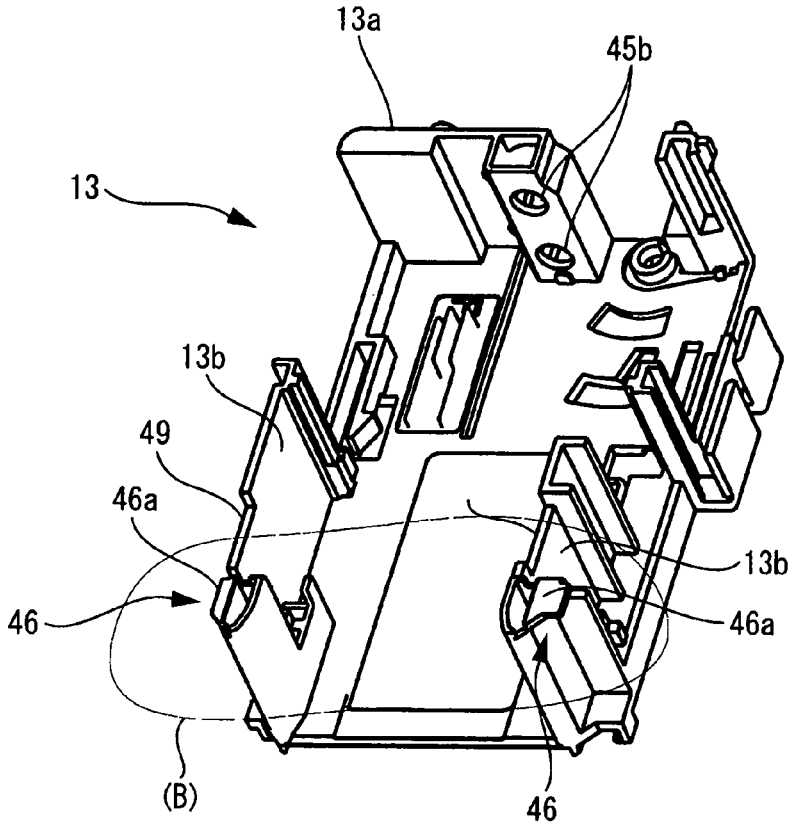
FIG. 11A is a perspective view of a cartridge holder as viewed from a top side.
Figure 11B:
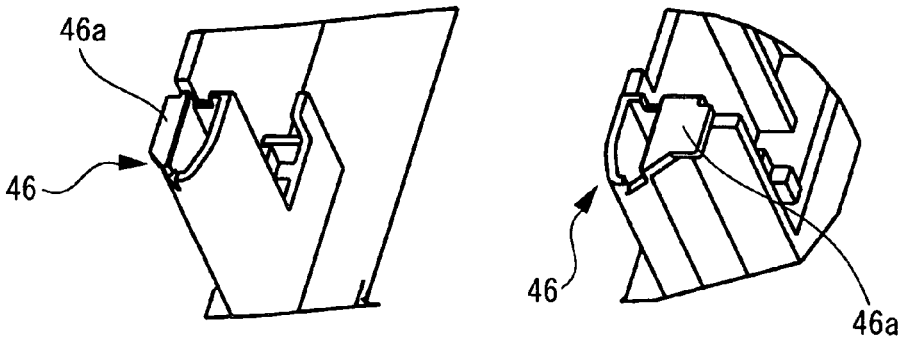
FIG. 11B is a perspective view of a locking claw.
Figure 12A:
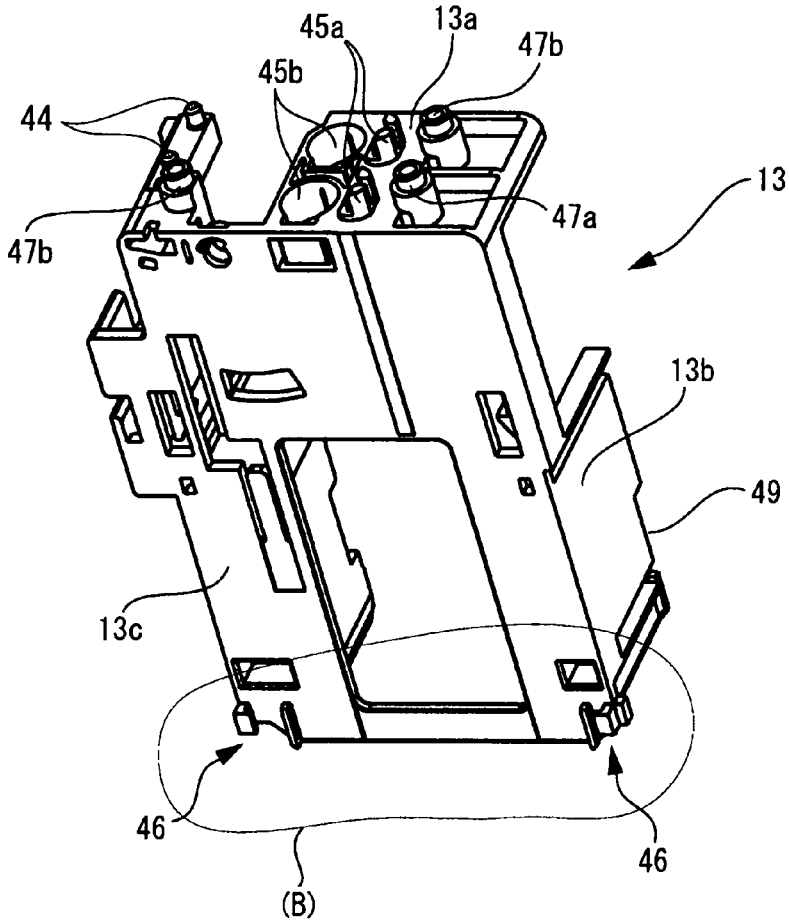
FIG. 12A is a perspective view of a cartridge holder as viewed from a bottom side.
Figure 12B:
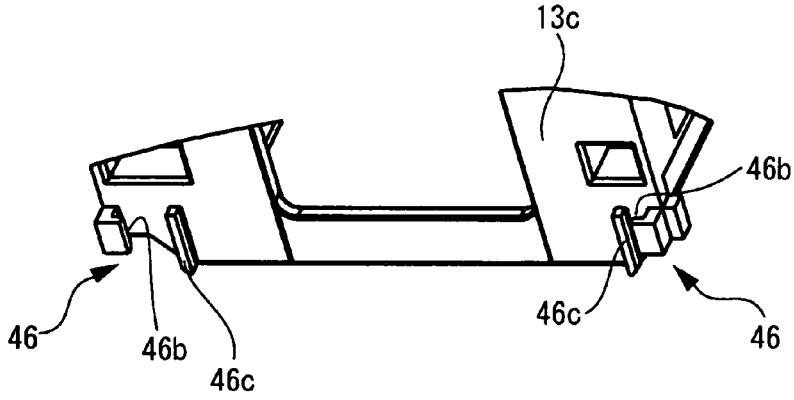
FIG. 12B is a perspective view of a receiving section.
Figure 13B:
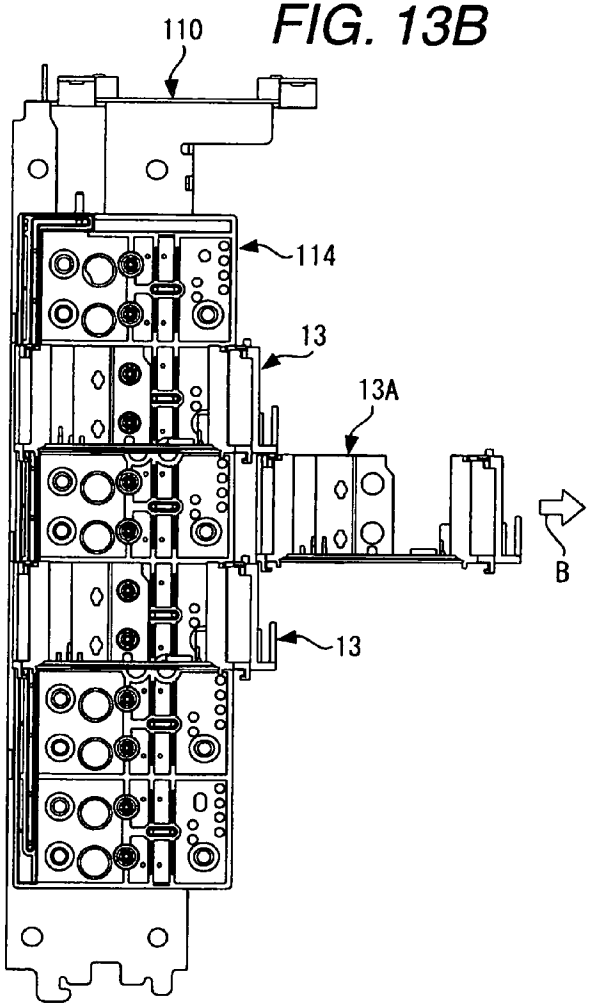
FIGS. 13A and 13B are a side view and a front view illustrating a process of taking out a cartridge holder at a middle position.
Figure 13A:
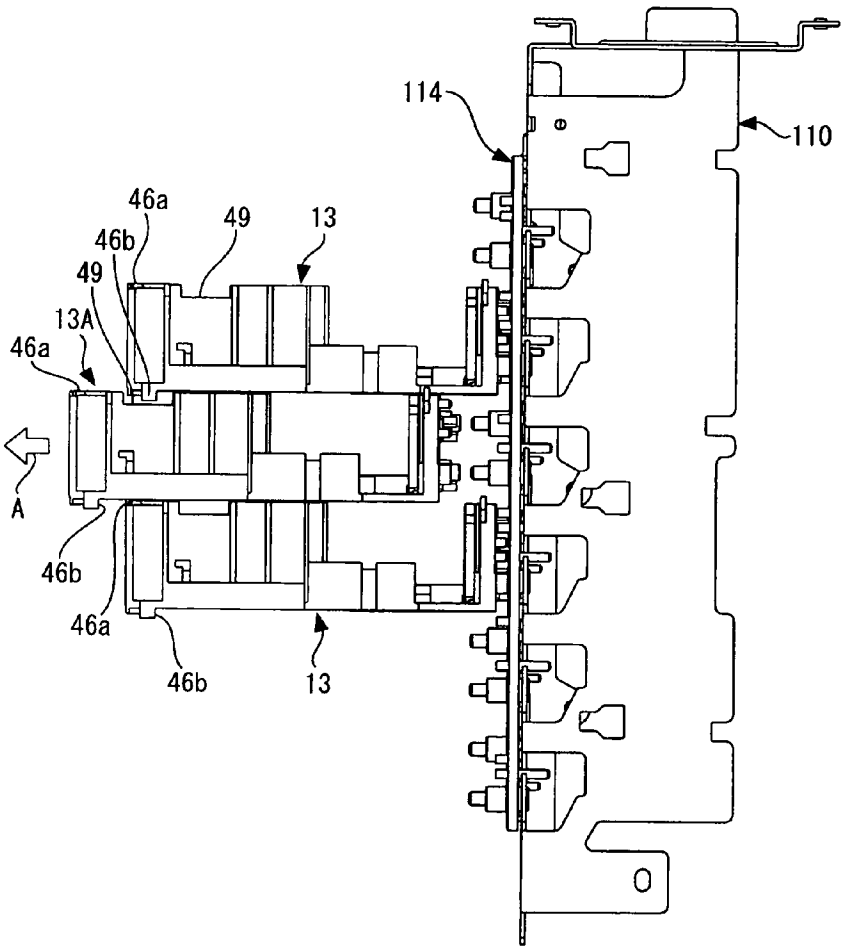
Figure 14:
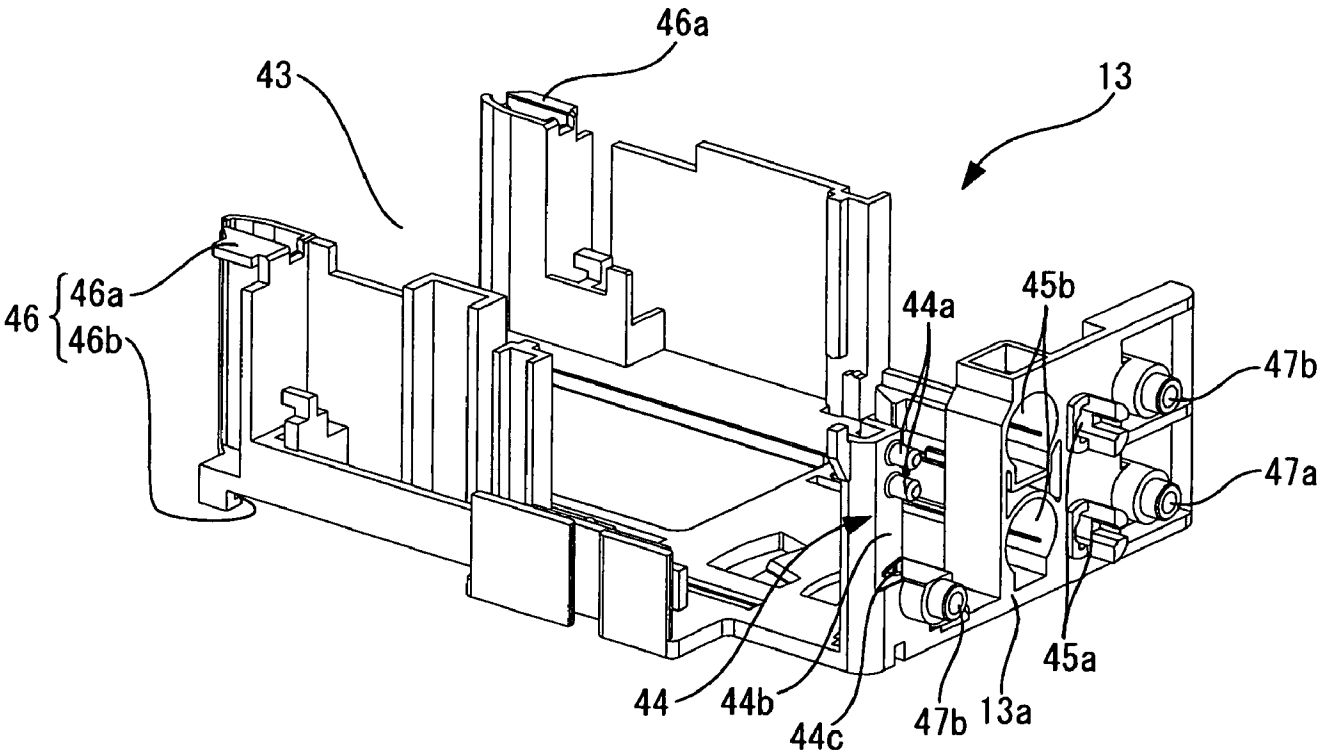
FIG. 14 is a perspective view of a cartridge holder.

FIG. 6 is a perspective view of the ink supplying mechanism as viewed from a side, FIG. 7 is a perspective view of the ink supplying mechanism as viewed from a front side, FIG. 8 is an exploded perspective view illustrating the ink supplying mechanism, FIG. 9 is a perspective view of a flow channel unit as viewed from a front side, FIG. 10 is a perspective view of the ink cartridge, FIG. 11A is a perspective view of the cartridge holder as viewed from a top side, FIG. 11B is an enlarged perspective view of the locking claw, FIG. 12A is a perspective view of the cartridge holder as viewed from a bottom side, FIG. 12B is an enlarged perspective view of the locking concave portion, FIGS. 13A and 13B are a side view and a front view illustrating a process of taking out the cartridge holder at a middle position, FIG. 14 is a perspective view of the cartridge holder, and FIGS. 15A to 15F are perspective views illustrating arrangement examples of identification protrusions different for each cartridge holder.

As shown in FIGS. 6 and 7, the ink supplying mechanism 71 has a frame 110 placed vertically to the base 72 (see FIGS. 2 to 4) of the publisher 1. The frame 110 is formed in an L shape in a cross-section view by bending and machining a steel plate. The frame 110 has a cartridge attachment plate part 111 and a valve unit attachment plate part 112. A substrate attachment plate part 113 above which a circuit substrate 118 is installed is horizontally formed in the frame 110.

The plurality of cartridge holders (for example, six cartridge holders in the exemplary embodiment) 13 constituting the cartridge attaching section 14 are fixed to the cartridge attachment plate part 111 through a plate-like flow channel unit 114. The ink cartridges 12 of the colors in which inks of colors such as black, cyan, magenta, yellow, light cyan, and light magenta are stored can be mounted on and demounted from the cartridge holders 13. The cartridge holders are generally represented by "the cartridge holder 13," and when the laminated cartridge holders are distinguished and represented, a cartridge holder which is located in the bottom end is represented by "a cartridge holder 13A" and then, the following cartridge holders sequentially laminated thereon are represented by "a cartridge holder 13B", "a cartridge holder 13C", "a cartridge holder 13D", "a cartridge holder 13E", and "a cartridge holder 13F".

As shown in FIGS. 8 and 9, the flow channel unit 114 provided between the cartridge attachment plate part 111 of the frame 110 and the cartridge holder 13 is formed in a plate shape and preferably made of synthetic resin. An ink flow channel and an air flow channel are formed therein. Ink emission sections 53 and air supplying member insertion holes 54 are vertically provided in the flow channel unit 114 in correspondence with air supplying member holding sections 45*a* and ink supplying needle holding sections 45*b* (see FIG. 12) of the cartridge holder 13 of the cartridge attaching section 14. One screw hole 55*a* and two screw holes 55*b* are provided in correspondence with screw holes 47*a* and 47*b* (see FIG. 12) of the cartridge holder 13.

An air introduction port 56 for introducing pressurization air is provided in an upper end portion of the flow channel unit 114, and a pipe-shaped air flow channel 57 is disposed facing downward. The air flow channel 57 is branched at a position corresponding to each cartridge holder 13 and is led to a rear surface. The air flow channel 57 is connected to the air supplying member mounted on the air supplying member holding section 45*a* of the cartridge holder 13 in each step through a pipe 58 (see FIG. 7) from the rear surface. The pipe 58 passes through the air supplying member insertion hole 54 from the rear surface, and the pipe 58 is disposed on a front surface.

An ink supplying needle (not shown) is attached to an inner side of the cartridge holder 13 in the ink emission section 53. The ink flow channels which are in communication with the ink emission section 53 are provided in the flow channel unit 114, and ink pumped from the ink cartridges 12 is led to the front surface of the frame 110 and is transported to a valve unit 122 mounted on the frame 110 through a connection tube 124 as shown in FIG. 7. The valve unit 122 is removably attached to a valve unit attachment plate part 112 of the frame 110 and has choke valves 121 corresponding to the ink cartridges 12 mounted on the cartridge holders 13.

As shown in FIG. 7, the valve unit 122 includes a plurality of connection pipes 127 protruding toward a side opposite a side in which the connection tube 124 is mounted. The connection pipes 127 are arranged substantially at a middle height position of the valve unit 122 at narrow intervals, and each of the connection pipes 127 is in communication with the corresponding choke valve 121. A flexible ink supplying tube 73 (see FIG. 4) connected to the carriage 62 is in communication with the connection pipes 127.

As shown in FIG. 9, flow channel identification sections 59 are provided at positions opposite cartridge holder identifying sections 44 (see FIGS. 8 and 12) provided on the cartridge holder 13 in each step on a front surface 114*a* onto which the cartridge holder 13 is attached in the flow channel unit 114. The cartridge holder identifying sections 44 and the flow channel identification sections 59 have a protrusion structure in which they do not interfere with each other only when a proper cartridge holder 13 is attached. When a wrong cartridge holder 13 is attached, the protrusions of the cartridge holder identifying section 44 and the flow channel identification section 59 interfere with each other, and the cartridge holder 13 cannot be mounted. It is thus possible to easily identify an incorrectly mounted cartridge.

FIG. 10 illustrates an example of the ink cartridge 12 housed in the cartridge holder 13.

The ink cartridge 12 has a substantially rectangular parallelepiped-shaped cartridge case 151, and a pair of air chambers separated by a partition plate are formed in the cartridge case 151. Ink packs 153 storing the ink are housed in the air chambers.

Ink emission members 154 which are in communication with interior portions of the ink packs 153 are provided in the ink packs 153. Attachment holes 155, which allow an inside and an outside of the cartridge case 151 to be in communication with each other, are provided in a central portion of a rear surface 151*a* of the cartridge case 151, and emission ports 154*a* of the ink emission members 154 are exposed through the attachment holes 155. The ink supplying needle disposed in the cartridge holder 13 is inserted into the emission port 154*a*, and the ink is emitted through the ink supplying needle. Air introduction holes 156 for injecting the air in the air chambers are provided adjacent the attachment holes 155 on the rear surface 151*a* of the cartridge case 151. A pair of insertion holes 157 are provided between the attachment holes 155 and the air introduction holes 156 on the rear surface 151*a* of the cartridge case 151. Positioning members in the cartridge holder 13 are inserted into the insertion holes 157 and are not in communication with an internal space of the cartridge case 151.

An IC chip 158 is provided in a front end portion of one surface of the cartridge case 151. The IC chip 158 is electrically connected to the control section 91 of the publisher 1 when the ink cartridge 12 is inserted and mounted into the cartridge holder 13. Information on the kind or the remaining amount of the ink in each of the ink packs 153 is stored in the IC chip 158.

In the ink cartridge 12, the pressurization air is introduced to the air chambers from the air introduction holes 156 of the cartridge case 151 and thus, the ink packs 153 are placed under pressure, whereby the ink stored in the ink packs 153 is pumped through the ink emission members 154.

As shown in FIGS. 11A and 12A, in the cartridge holder 13 housing the above-mentioned ink cartridges 12, openings 43 for taking the ink cartridge 12 in and out are provided on a front surface thereof, and the cartridge holder 13 is formed in the shape of a substantially rectangular parallelepiped box of which the top surface is opened. The air supplying member holding sections 45*a* holding the air supplying members for injecting the air in the air chambers of the ink cartridges 12 are provided on the rear surface 13*a* of the cartridge holder 13 in correspondence with the air introduction holes 156 of the ink cartridges 12. The ink supplying needle holding sections 45*b* are provided in correspondence with the ink emission members 154 for pushing the ink from the ink cartridges 12 by injection of the air. The air supplying member holding sections 45*a* and the ink supplying needle holding sections 45*b* each are provided in two steps in correspondence with configurations of the ink cartridges 12. The screw hole 47*a* for fixing the cartridge holder 13 to the flow channel unit 114 and the screw hole 47*b* for fixing the cartridge holder 13 in which the flow channel unit 114 is inserted to the frame 110 are provided. In the exemplary embodiment, for example, the screw hole 47*a* is provided in one location, and the screw holes 47*b* are provided in two locations.

The cartridge holder identifying sections 44 for identifying proper attaching positions of the cartridge holders 13 on the flow channel unit 114 are provided on the front surfaces of the cartridge holders 13.

Hereinafter, the cartridge holder identifying sections 44 will be described with reference to FIGS. 14 and 15.

The cartridge holder identifying sections 44 are provided in a left end portion of the rear surface 13*a* of the cartridge holder 13. A plurality of identifying holder protrusions 44*a* are provided in the cartridge holder identifying sections 44, and dispositions of the identifying holder protrusions 44*a* are different for each cartridge holder 13. In FIGS. 15A to 15F, arrangement examples of the identifying holder protrusions 44*a* are shown with respect to the cartridge holders 13A, 13B, . . . , 13F. The identifying holder protrusions 44*a* protrude rearward on a base plate 44*b*. The base plate 44*b* has a vertically long space in which four identifying holder protrusions 44*a* can be provided. An identification symbol 44*c* for each cartridge holder 13 is disposed in a lower end portion of the base plate 44*b*.

Figure 15A:
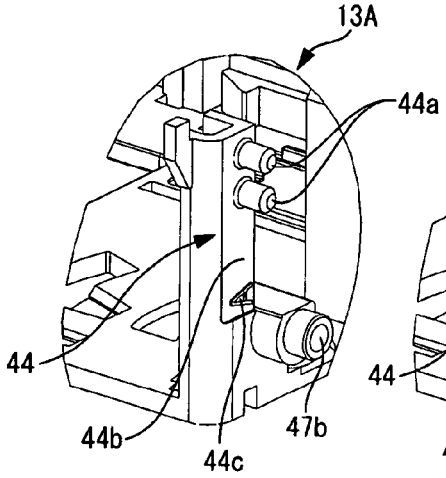
FIGS. 15A to 15F are a partially enlarged perspective view illustrating an arrangement example of identification protrusion protrusions different for each cartridge holder.
Figure 15B:
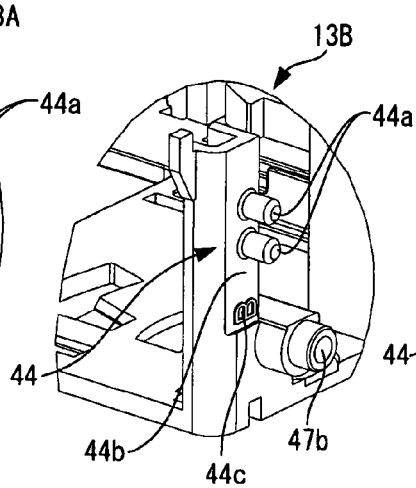
Figure 15C:
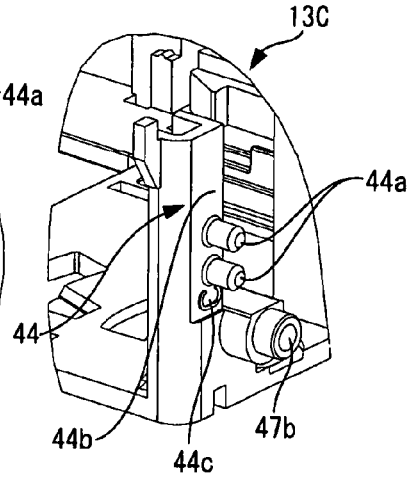
Figure 15D:
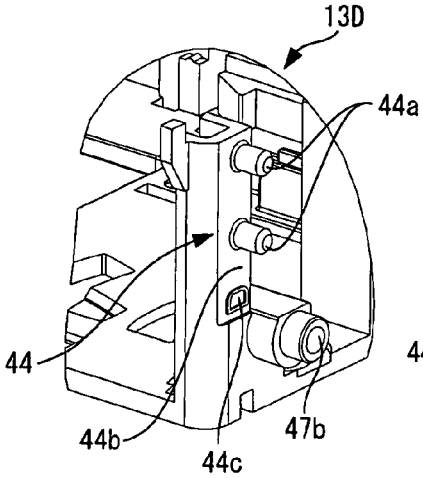
Figure 15E:
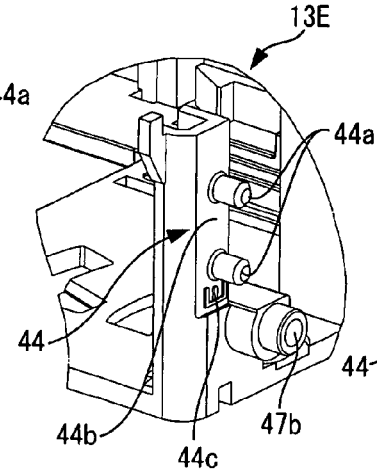
Figure 15F:
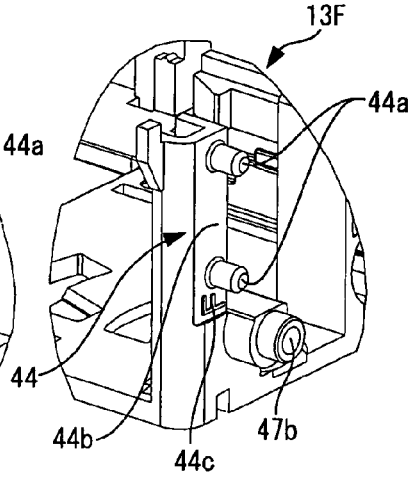
Figure 16:
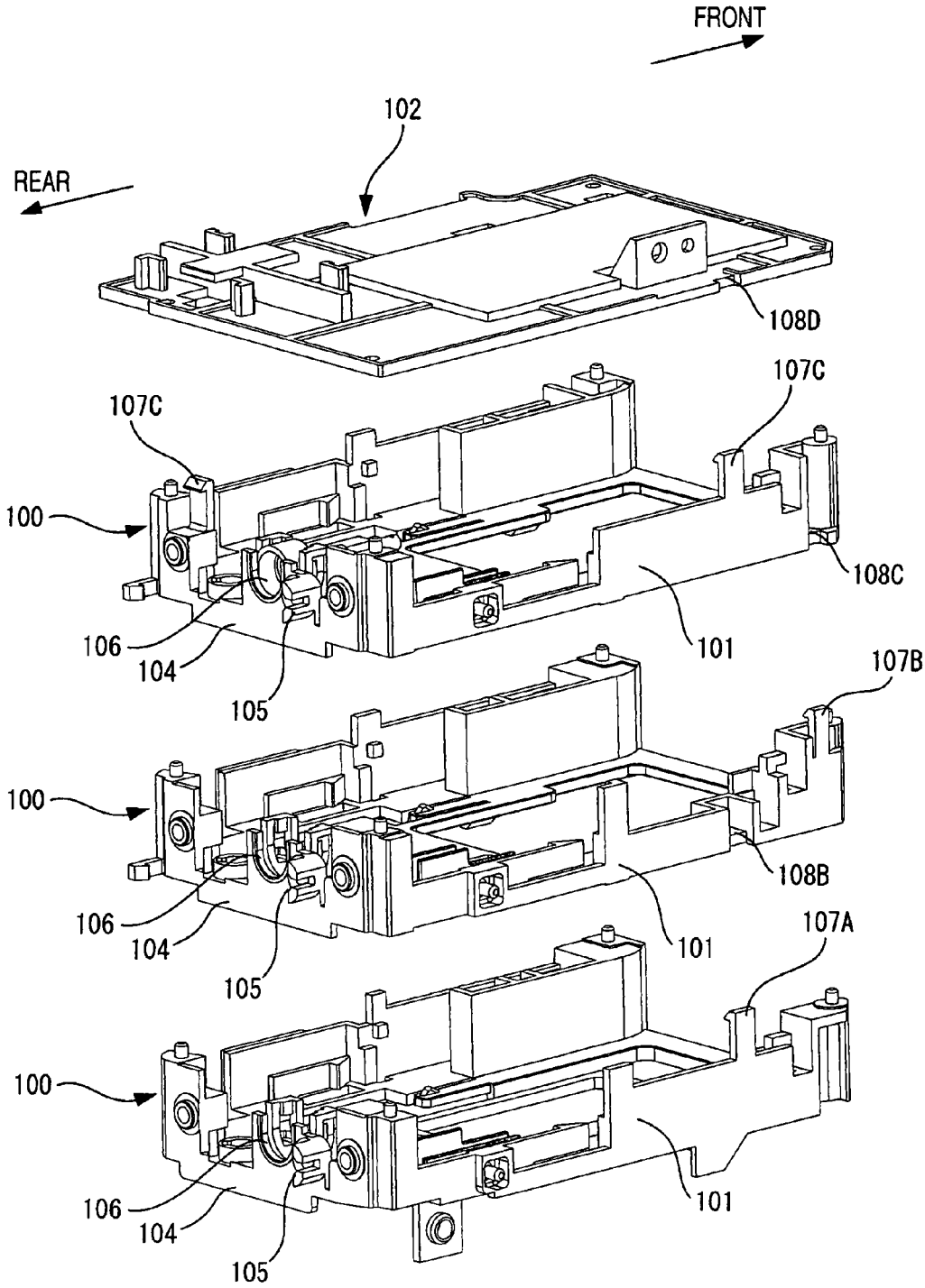
FIG. 16 is an exploded perspective view illustrating an example of a known cartridge holder.
Figure 17:
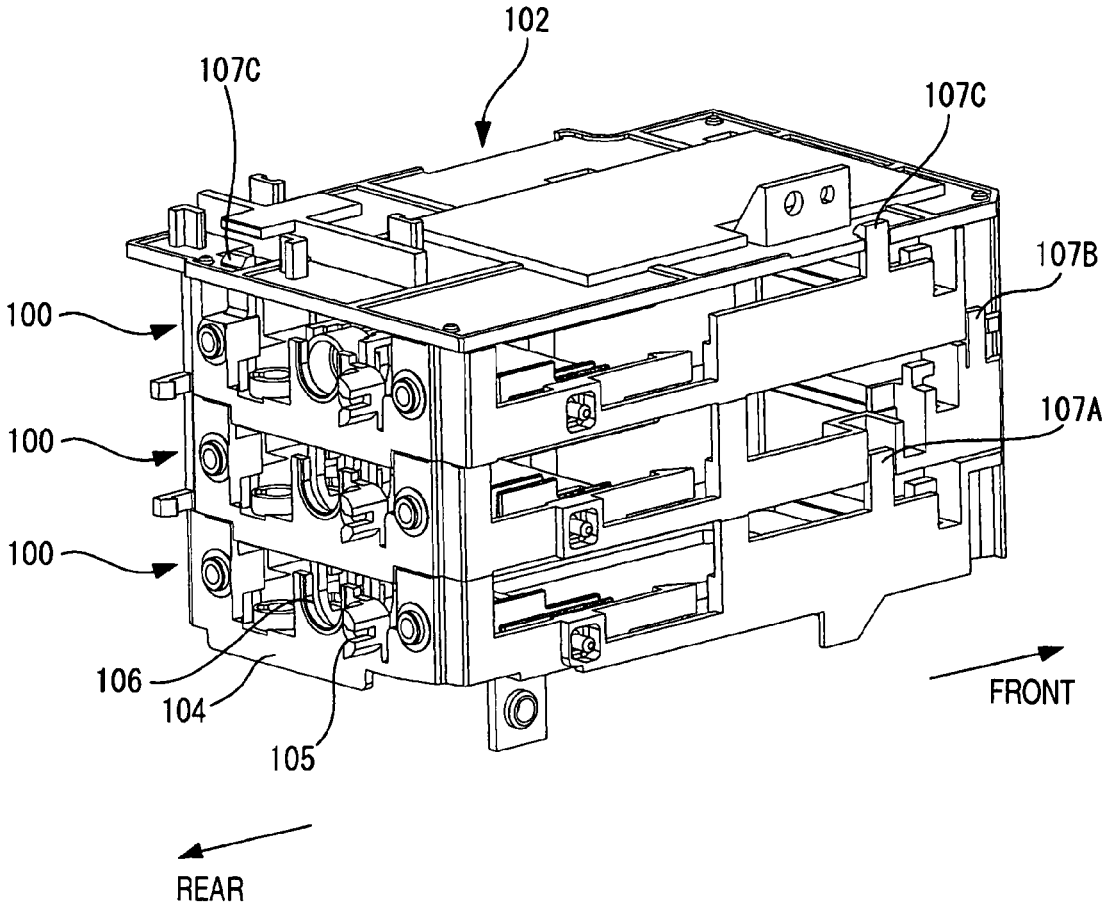
FIG. 17 is a perspective view illustrating an example of a structure in which a known cartridge holder is mounted.

As shown in FIG. 15A, in the bottom cartridge holder 13A, the identifying holder protrusions 44*a* are disposed in a first step and a second step from the top side, and the symbol 44*c* is denoted by "A". The identification symbol 44*c* is provided so that operating personnel can identify a cartridge holder 13 at first sight since it is difficult to identify any cartridge holder 13 only by considering the dispositions of the identifying holder protrusions 44*a*. As shown in FIG. 15B, in the cartridge holder 13B in the second step from the bottom side, the identifying holder protrusions 44*a* are disposed in the second step and a third step and the identification symbol 44*c* is denoted by "B". Hereinafter, similarly, the identifying holder protrusions 44*a* are provided in the cartridge holder 13C to the cartridge holder 13F in different disposition patterns.

Since the different cartridge holders 13A to 13F can be formed in the same die by excluding the cartridge holder identifying sections 44 at the time of molding the cartridge holders 13A to 13F, the dispositions of the identifying holder protrusions 44*a* of the cartridge holder identifying sections 44 and a die component in a part corresponding to the identification symbol 44*c* are changeable, whereby a common die can be used as the die molding for all the cartridge holders. Accordingly, it is possible to reduce a manufacturing cost of the cartridge holder 13.

Cartridges storing inks of colors to be mounted are determined for the cartridge holders 13A to 13F. Therefore, the cartridge holders 13A to 13F and the ink cartridges 12 have improper insertion prevention structure for allowing only ink cartridges 12 of predetermined colors to be mounted for each of cartridge holders 13A to 13F.

Locking means is provided in the cartridge holders 13, which locks the cartridge holders 13 to each other at the time of laminating the plurality of cartridge holders 13. The locking means is described in detail below.

As shown in FIGS. 11A and 12A, locking means 46 locking the cartridge holders by vertically overlapping the cartridge holders 13 with each other is provided in top and bottom parts in front of both right and left side walls 13*b* of each cartridge holder 13. The cartridge holders 13 are slidable in an attachment direction of the cartridge holders 13 and in the opposite direction with respect to the cartridge holders 13 vertically adjacent each other by the locking means 46. Therefore, it is possible to individually remove the cartridge holders 13 without removing the cartridge holders 13 vertically adjacent each other by drawing out the cartridge holders 13 in a removal direction opposite to an attachment direction thereof.

For example, as shown in FIG. 11A, locking claws 46*a* (first engaging portions) as the locking means 46 protruding toward both right and left outsides as shown in FIG. 11B are provided in upper end portions in front of both right and left side walls 13*b*. As shown in FIG. 12B, receiving pieces 46*b* (second engaging portions) formed in an L shape for engaging with the locking claws 46*a* protrude downward in both right and left end portions in front of a bottom surface 13*c* of the cartridge holder 13.

Protrusions 46*c* are provided in the attachment directions of the cartridge holders 13*c* in opposition with insides (right and left insides) which are open sides of the receiving pieces 46*b*. Accordingly, movements of the locking claws 46*a* of the adjacent lower cartridge holders in right and left directions can be prevented by collaboration of the protrusions 46*c* and the receiving pieces 46*b* when the cartridge holders 13 are vertically laminated, and a difficulty in taking the ink cartridges 12 in and out can be prevented by inward fall-down of the side walls 13*b* of the cartridge holders 13 accompanied by the movements of the locking claws 46*a* in the right and left directions. The inward fall-down of the side walls 13*b* may occur at the time of manufacturing the cartridge holders 13 by injection molding.

As shown in FIG. 11A, notches 49 having a size in which the receiving pieces 46*b* and the protrusions 46*c* can pass in a direction perpendicular to the attachment direction (that is, right and left directions) are provided in the vicinity of the front side of the attachment direction from the locking claws 46*a* in the upper end portions of the side walls 13*b* of the cartridge holders 13.

Next, a attaching the cartridge holders 13 will be described.

As shown in FIG. 8, the plurality of cartridge holders 13 are laminated in a predetermined order, and the cartridge holders 13 are connected to each other. The operating personnel mounts the cartridge holders 13 so that the identification symbols 44*c* represent A, B, C, D, E, and F sequentially from the bottom while confirming the identification symbols 44*c* indicated in the cartridge holder identifying sections 44 of the cartridge holders 13. Next, the operating personnel abut the flow channel unit 114 on the rear surfaces (right surfaces in FIG. 8) of the cartridge holders 13. Since the identifying holder protrusions 44*a* of the cartridge holders 13 and flow channel protrusions 59*a* of the flow channel unit 114 interfere with each other when an attaching sequence of the cartridge holders 13 is wrong, the operating personnel cannot fasten screws 64*a* on the cartridge holders 13. As a result, the operating personnel can confirm attaching states between the cartridge holders 13 with the naked eye. When the cartridge holders 13 are correctly connected to each other, the operating personnel abut the flow channel unit 114 on the cartridge holders 13. First, the operating personnel pass one screw 64*a* through a screw hole 55*a* of the flow channel unit 114 with respect to each cartridge holder 13 and tightly fasten the one screw 64*a* on a screw hole 47*a* (see FIG. 14) of the cartridge holder 13.

After the flow channel unit 114 is mounted on all cartridge holders 13, a front surface of the frame 110 abuts on a rear surface of the flow channel unit 114, two screws 64*b* pass through two screw holes 65*b* of the frame 110 and through screw holes 55*b* of the flow channel unit 114, and the two screws 64*b* are tightly fastened on the screw holes 47*b* of each cartridge holder 13. At this time, a head of the screw 64*a* protrudes toward the rear surface of the flow channel unit 114, but by making sizes of screw holes 65*a* (see FIG. 7) of the frame 110 larger than that of the head of the screw 64*a*, interference can be evaded, and the screws 64*a* can be fastened and removed even after the frame 110 is attached.

In the above-mentioned attaching process, although the flow channel unit 114 is mounted on the cartridge holders 13 after the plurality of cartridge holders 13 are laminated and connected to each other, the cartridge holders 13 may be mounted on the flow channel unit 114 in a different sequence one by one.

As described above, in accordance with the liquid ejecting apparatus provided with the cartridge holders of the exemplary embodiment, identifying protruding portions having the identifying holder protrusions 44*a* and the flow channel protrusions 59*a* having a structure in which a plurality of protrusions are combined are provided on opposed surfaces of the cartridge holders 13 and the flow channel unit 114 opposed to each other so that the cartridge holder 13 and a predetermined attaching position thereof correspond to each other one to one. Therefore, the identifying holder protrusions 44*a* of the cartridge holder 13 and the flow channel protrusions 59*a* of the flow channel unit 114 interfere with each other when attaching the cartridge holders 13 to positions other than predetermined positions of the flow channel unit 114, whereby it is difficult to attach the cartridge holders 13. Accordingly, it is possible to prevent the cartridge holders 13 from being mounted in improper positions of the flow channel unit 114. Accordingly, inks of correct colors are supplied to the nozzle of the inkjet head 62 from the flow channel unit 114, and printing using correct colors.

Since the different cartridge holders 13A to 13F can be formed in the same die by excluding the cartridge holder identifying sections 44 protruding toward a surface opposite the flow channel unit 114 at the time of molding the cartridge holders 13A to 13F, the dispositions of the identifying holder protrusions 44*a* of the cartridge holder identifying sections 44 and a die component in a part corresponding to the identification symbol 44*c* are changeable, whereby a common die can be used as the die molding the whole cartridge holders. In particular, a structure in which the protrusions are combined is applied to a configuration of the identifying protruding portion, whereby it is easy to change the die component for forming the protrusion. Accordingly, it is possible to reduce the manufacturing cost of the cartridge holder 13 and thus, a manufacturing cost of the publisher 1, to which the liquid ejecting apparatus of the exemplary embodiment is applied, is reduced.

The liquid ejecting apparatus provided with the cartridge holders described herein is not limited to the above-mentioned exemplary embodiment. The liquid ejecting apparatus may include modifications or improvements.

For example, in the above-mentioned exemplary embodiment, two identifying holder protrusion 44*a* of the cartridge holder 13 and two flow channel protrusions 59*a* of the flow channel unit 114 are provided, but the number of protrusions is not limited to two.

A case in which protrusions are provided as the cartridge holder identifying portions 44 of the cartridge holder 13 and the flow channel identifying portions 59 of the flow channel unit 114 is described, but the protrusion may be used as one identification portion, and concave portions in which the protrusions fit may be used as the other identification portion.

Next, removal of the cartridge holder 13A attached at the middle position will be described with reference to FIGS. 8, 13A, and 13B.

In the attachment state, each of cartridge holders 13 is fixed to the flow channel unit 114 by the screw 64*a*, and each cartridge holder 13 in which the flow channel unit 114 is inserted is fixed to the frame 110 by the screw 64*b*. Therefore, first, the cartridge holder 13B is removed from the flow channel unit 114 and is drawn out to the front side by removing the screws 64*a* and 64*b* of the cartridge holder 13B (an arrow A of FIG. 13A). At this time, the cartridge holder 13B is drawn out until the locking claws 46*a* of the cartridge holder 13A are displaced from the receiving pieces 46*b* provided on the bottom surface 13*c* of the upper cartridge holder 13C, and the receiving pieces 46*b* of the cartridge holder 13A are displaced from the locking claws 46*a* of the lower cartridge holder 13A. When the notches 49 of the cartridge holder 13B reach the receiving pieces 46*b* of the upper cartridge holder 13C, the cartridge holder 13A moves in a direction perpendicular to the removing direction, for example, in a right direction as shown in FIG. 13B (an arrow B of FIG. 13B). Since the receiving pieces 46*b* and the protrusions 46*c* of the upper cartridge holder 13 can pass through the notches 49, the cartridge holder 13B can be removed transversely.

An arbitrary cartridge holder 13 slides slightly in the removing direction when the plurality of cartridge holders 13 are locked to each other and is moved in a transverse direction by the notches 49, whereby even the middle cartridge holder 13A adjacent both the upper and lower different cartridge holders 13 can be easily taken out individually. Shapes of the side walls 13*b* are designed so that the cartridge holders 13 do not interfere with each other in the overall attachment direction length assuming that the amount of slide required for removal extends throughout the overall attachment direction length of the cartridge holders 13. In accordance with the configuration in which the notches 49 are provided, sliding in the attachment direction is limited, and thus, design flexibility of the cartridge holders 13 is improved.

As described above, in accordance with the liquid ejecting apparatus provided with the cartridge holders of the exemplary embodiment, since each of the cartridge holders 13 is slidably locked with the flow channel unit 114 in the attachment direction of the cartridge holders 13 and in the opposite direction by guiding of the locking means 46, the middle cartridge holder 13A adjacent the upper and lower different cartridge holders 13 can be individually removed by drawing out the cartridge holders 13 in the direction opposite to the attachment direction. At this time, for example, the cartridge holders 13 adjacent the upper side can be locked by the locking claws 46*a*, and the receiving pieces 46*b* can be locked by the locking claws 46*a* of the cartridge holders 13 adjacent the lower side.

Since the notches 49 where the receiving pieces 46*b* can pass in the direction perpendicular to the removing direction are provided in the vicinity of the front side of the attachment direction in the upper end portions of the side walls 13*b* of the cartridge holders 13, the middle cartridge holder 13A adjacent the upper and lower other cartridge holders 13 can be individually taken out by slightly sliding the cartridge holder 13A in the removing direction from a locking state and moving the cartridge holder 13A in the direction perpendicular to the removing direction. Accordingly, since a complicated procedure of removing all the cartridge holders from the flow channel unit and disassembling all the cartridge holders into individual cartridge holders in the related art is not required at the time of removing the middle cartridge holder, workability is improved.

As described above, in the liquid ejecting apparatus of the exemplary embodiment, even though the cartridge holders 13 are required to be removed during use of the cartridge holders 13, an arbitrary cartridge holder 13 can be removed from the flow channel unit 114, whereby maintenance is made easier. Since all the cartridge holders 13 are not required to be disassembled into the individual cartridge holders 13, the number of attachments or detachments between the cartridge holders 13 and the cartridge holders 13 or the flow channel unit 114 can be decreased, thereby reducing wear of the components such as the cartridge holders 13 and the flow channel unit 114. Accordingly, since reliability of attaching the cartridge holders 13 on the flow channel unit 114 can be maintained, ink supply of high reliability from the ink supplying mechanism 71 can be maintained and thus, a high printing quality can be maintained.

The liquid ejecting apparatus provided with the cartridge holders described herein is not limited to the above-mentioned exemplary embodiment. The liquid ejecting apparatus may include further modifications or improvements.

For example, in the above-mentioned exemplary embodiment, the cartridge holder 13A is removed by drawing out the cartridge holder 13A in the removing direction and moving he cartridge holder 13A in the direction perpendicular to the removing direction. The cartridge holders 13 may be taken out by completely drawing out the cartridge holders in the removing direction by providing the receiving pieces 46*b* throughout the overall lengths of the cartridge holders 13.

In the above-mentioned exemplary embodiment, a case in which the locking claws 46*a* as the locking means 46 which do not protrude toward the upper side in upper portions of the side walls of the cartridge holders 13 and the receiving pieces 46*b* protruding toward the lower side is provided on the bottom surfaces 13*c* of the cartridge holders 13 is described, but the locking claws 46*a* may protrude toward the upper side, and the receiving pieces 46*b* may not protrude toward the lower side. Additionally, the locking claws may protrude from a lower side surface, and the receiving portion thereof may be provided on an upper side surface. In this case, a space portion such as a notch having a depth larger than a protrusion height may be formed so that the protruding portion can pass therethrough in a direction perpendicular to the arranging direction of the cartridge holders The cartridge holders are described by the exemplary embodiment in which an upper side of each cartridge holder is opened, but in this case, one locking claw may be provided in the center of a top plate, and one receiving portion corresponding to the locking claw may be provided in the center of the top plate. The protrusions as the identifying engaging portions are provided on opposed surfaces of the cartridge holder and the flow channel unit are described, but concave portions may be provided on any one of the cartridge holder and the flow channel unit.

In addition, although the case in which the cartridge holders 13 are stacked is described in the above-mentioned exemplary embodiment, the cartridge holders 13 may be arranged in a widthwise direction.

In the above-mentioned exemplary embodiment, the liquid ejecting apparatus is not limited to the label printer 11 performing printing on the label surface of disk-like media such as the CDs and the DVDs is applied to the publisher 1 processing the media, but the liquid ejecting apparatus may be a printer performing printing on sheet-shaped recording media such as paper or a complex machine having a facsimile function or a copy function, or a testing apparatus discharging test liquid to a predetermined location with a cartridge storing the test liquid.

The entire disclosure of Japanese Patent Application Nos. 2006-222805 filed on Aug. 17, 2006 and 2006-222806 filed on Aug. 17, 2006 are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A liquid ejecting apparatus comprising:

a flow channel unit having a liquid flow channel for supplying a liquid stored in a liquid cartridge; and a plurality of cartridge holders, including a first cartridge holder and a second cartridge holder adjacent to each other, and attached to the flow channel unit while the plurality of cartridge holders are arranged in a first direction, each of the plurality of cartridge holders being adapted to hold a liquid cartridge and having a first engaging portion and a second engaging portion, wherein:

the first engaging portion of the first cartridge holder and the second engaging portion of the second cartridge holder are engageable with each other to lock the first and second cartridge holders, and the first engaging portion of the first cartridge holder and the second engaging portion of the second cartridge holder are disengageable from each other to unlock the first and second cartridge holders when one of the first and second cartridge holders is moved in a second direction that is apart from the flow channel unit.

2. The liquid ejecting apparatus according to claim 1, wherein the first engaging portion and the second engaging portion of each of the plurality of cartridge holders are disposed on a side apart from the flow channel unit.

3. The liquid ejecting apparatus according to claim 2,wherein at least one of the first engaging portion of the second cartridge holder and the second engaging portion of the second cartridge holder is protruded toward the first cartridge holder, the first cartridge holder including a notch that has a depth larger than a protrusion height of the at least one of the first engaging portion of the second cartridge holder and the second engaging portion of the second cartridge holder, and wherein the notch is positioned to a side of the flow channel unit with respect to at least one of the second engaging portion of the first cartridge holder and the first engaging portion of the first cartridge holder, the at least one of the first engaging portion of the second cartridge holder and the second engaging portion of the second cartridge holder being passable through the notch in a direction perpendicular to the first direction.

4. The liquid ejecting apparatus according to claim 2, wherein the first engaging portion of each of the plurality of cartridge holders is a locking claw which is provided at a first end portion thereof in the first direction, and wherein the second engaging portion of each of the plurality of cartridge holders is a receiving portion which protrudes from a second end portion thereof opposing the first end portion in the first direction and which is engageable with the locking claw.

5. The liquid ejecting apparatus according to claim 4, wherein the receiving portion has:

a receiving piece of an L shape which protrudes from a wall surface; and a protrusion which is disposed on an open side of the receiving piece that blocks a movement of the locking claw engaging with the receiving portion toward the open side.

6. The liquid ejecting apparatus according to claim 1, wherein the first cartridge holder has a plurality of protrusions that are acceptable to a first position of the flow channel unit, and the second cartridge holder has a plurality of protrusions that are arranged in a different manner than the first cartridge holder and that are acceptable to a second position of the flow channel unit that is different from the first position.

7. The liquid ejecting apparatus according to claim 6, wherein the first position of the flow channel unit has at least one protrusion that does not interfere with the plurality of protrusions of the first cartridge holder and that does interfere with the plurality of protrusions of the second cartridge holder, and the second position of the flow channel unit has at least one protrusion that does not interfere with the plurality of protrusions of the second cartridge holder and that does interfere with the plurality of protrusions of the first cartridge holder.

8. The liquid ejecting apparatus according to claim 1, further comprising an identification mechanism that allows a particular cartridge holder to be attached to the flow channel unit when the particular cartridge holder is disposed on a predetermined position of the flow channel unit and does not allow the particular cartridge holder to be attached to the flow channel unit when the particular cartridge holder is disposed on a position other than the predetermined position of the flow channel unit.

9. The liquid ejecting apparatus according to claim 8, wherein the identification mechanism comprises an identification engaging portion of the particular cartridge holder and an identification engaging portion of the flow channel unit at a face at which the particular cartridge holder and the flow channel unit are opposed to each other, and wherein each of the plurality of cartridge holders has an identification engaging portion that is different from that of all others of the plurality of cartridge holders.

10. The liquid ejecting apparatus according to claim 9, wherein the particular cartridge holder is prevented from being attached to the flow channel unit by interference of the identification engaging portion of the flow channel unit that allows one of the others of the plurality of cartridge holders to be attached thereto when the particular cartridge holder is disposed at a position other than the predetermined position of the flow channel unit.

11. The liquid ejecting apparatus according to claim 10, wherein the identification mechanism comprises a combination of a plurality of protrusions, wherein the identification engaging portion of each of the plurality of cartridge holders has a plurality of protrusions arranged in a different manner from the others of the plurality of cartridge holders, and wherein the identification engaging portion of the flow channel unit has at least one protrusion provided at a position which does not interfere with only the protrusions of a cartridge holder to be attached thereto.

* * * * *